US006138686A

United States Patent [19]

Yuhara

[11] Patent Number: 6,138,686

[45] Date of Patent: Oct. 31, 2000

[54] COSMETIC CASE

[75] Inventor: Yukitomo Yuhara, Chiba, Japan

[73] Assignee: Yoshida Industry Co. Ltd., Tokyo, Japan

[21] Appl. No.: 09/427,307

[22] Filed: Oct. 26, 1999

[30] Foreign Application Priority Data

| | | | |
|---|---|---|---|
| Oct. 28, 1998 | [JP] | Japan | 10-307178 |
| Oct. 28, 1998 | [JP] | Japan | 10-307179 |
| Nov. 12, 1998 | [JP] | Japan | 10-322619 |
| Nov. 17, 1998 | [JP] | Japan | 10-327171 |
| Nov. 17, 1998 | [JP] | Japan | 10-327172 |
| Dec. 1, 1998 | [JP] | Japan | 10-341999 |
| Dec. 7, 1998 | [JP] | Japan | 10-346989 |

[51] Int. Cl.[7] ..... A45D 33/24; A45D 33/00; A45D 33/22; B65D 69/00

[52] U.S. Cl. ..... 132/294; 132/293; 132/295; 206/581; 206/823

[58] Field of Search ..... 132/294, 295, 132/296, 293, 300; 206/581, 823, 235; 220/23.91, 23.87, 23.89, 844

[56] References Cited

U.S. PATENT DOCUMENTS

| | | | |
|---|---|---|---|
| 2,078,096 | 4/1937 | Parkin . | |
| 5,353,818 | 10/1994 | Suzuki et al. | 132/300 |
| 5,845,658 | 12/1998 | Sussman | 132/287 |
| 5,875,795 | 3/1999 | Bouix | 132/293 |
| 5,896,866 | 4/1999 | Quennessen | 132/293 |
| 5,950,639 | 9/1999 | Suzuki et al. | 132/294 |
| 6,076,679 | 6/2000 | Yuhara et al. | 206/581 |

FOREIGN PATENT DOCUMENTS

| | | |
|---|---|---|
| 58-40003 | 3/1983 | Japan . |
| 63-28407 | 2/1988 | Japan . |
| 3-123411 | 12/1991 | Japan . |
| 8-347 | 1/1996 | Japan . |
| 8-348 | 1/1996 | Japan . |
| 8-38242 | 2/1996 | Japan . |
| 8-196337 | 8/1996 | Japan . |
| 9-37838 | 2/1997 | Japan . |
| 9-47319 | 2/1997 | Japan . |
| 9-65920 | 3/1997 | Japan . |
| 9-98828 | 4/1997 | Japan . |
| 9-98829 | 4/1997 | Japan . |
| 9-140441 | 6/1997 | Japan . |
| 10-192043 | 7/1998 | Japan . |
| 10-192044 | 7/1998 | Japan . |

*Primary Examiner*—John J. Wilson
*Assistant Examiner*—Robyn Kieu Doan
*Attorney, Agent, or Firm*—Harness, Dickey & Pierce, P.L.C.

[57] ABSTRACT

A cosmetic case comprised of an outer main case, a main case cover, an internal cosmetic filled container, and a container cover whereby the main case cover and container cover do not overlap when open. The purposes of the invention are to improve the cosmetic substance filling process, to improve the cosmetic case assembly process, to more effectively seal the cosmetic material held in the container, and to provide for more convenient operation and usage of the cosmetic case.

17 Claims, 44 Drawing Sheets

COSMETIC CASE

BACKGROUND OF THE INVENTION

1. Field of the Invention

The invention relates to a cosmetic case comprised of a main case to which an outer cover is pivotably attached as means of covering or exposing the internal space of the case, and an inner cover as means of sealing or exposing a compartment within the main case.

2. Description of the Related Art

Japanese unexamined patent publication Nos. 10-192043 and 10-192044 describe a cosmetic case structure comprised of a case to which a main cover is pivotably attached to the rear extremity thereon by means of a hinge, a mirror attached to the underside of the main case, and a latch located at the front extremity of the main case.

The aforesaid 10-192043 patent publication describes a cosmetic case of the type incorporating a cosmetic applicator tool removably installed within a rear case space, and a cosmetic refill container removably installed within a front case space.

The aforesaid refill container is structured so as to include a container tray filled with a cosmetic material, and a cover part capable of pivotably exposing or covering the aforesaid cosmetic material.

A container latch mechanism, comprised of a joint lip formed on the aforesaid container cover and latch piece formed on the aforesaid tray part, is provided as means whereby the container cover is able to atmospherically seal the tray part through the aforesaid latch structure as well as a packing piece installed around the perimeter of the aforesaid tray part.

The aforesaid 10-192044 patent publication describes a cosmetic case wherein a divider wall is installed as means of dividing the internal case space into two separate compartments, a cosmetic applicator tool is removably stored in the rear compartment, and a cosmetic material filled container tray part is installed in the front compartment.

A cutout space is provided within the aforesaid divider wall, and a hinge pin is inserted through both sides of the cutout space, the hinge pin serving as the rotational axis of a container cover part that is thus able to pivot as means of exposing or sealing the cosmetic material contained in the tray part, this structure being essentially similar to that described by the 10-192043 patent publication.

A container latch mechanism, comprised of a joint lip formed on the aforesaid container cover and latch piece formed on the aforesaid tray part, is provided whereby the container cover is able to atmospherically seal the tray part by means of the joint formed by the aforesaid latch structure and a packing piece installed around the perimeter of the aforesaid tray part.

In order to use both of the cosmetic cases described above, first the latch holding the case cover closed must be released, the case cover must then be rotated up and rearward, the joint holding the cosmetic container cover closed must be released, and the container cover opened by rotating it up and rearward.

Moreover, both of these cosmetic containers use a latch structure consisting of a clasp protruding from the front of the case, and a connector part vertically installed to the front center area of the case cover. Japanese unexamined patent publication No. 9-140441 describes a cosmetic case latch structure incorporating a release mechanism comprised of several separate parts, said release mechanism operating so as to push up on the case cover to release the joint formed by the latch.

All of the latch mechanisms described above are located so as to open the case cover and container cover in the same rearward direction, thus resulting in the container cover overlapping and covering a part of the mirror installed to the underside of the case cover. Furthermore, because the container cover overlaps the case cover, the container cover is unable to fully open, thus restricting access to the cosmetic material.

Because the aforesaid cosmetic applicator tool storage space is provided at the rear of the case, and because that space is blocked by the open container cover, it becomes necessary to close the container cover in order to temporarily return the applicator tool to its storage space. It is also necessary to have the container cover closed in order to take out the cosmetic applicator tool. These two factors make the cosmetic case awkward to handle and inconvenient to use.

Moreover, cosmetic cases of the type incorporating an internal replaceable refill container make use of a pin-type hinge integrally formed with the main case, thus resulting in a structure in which the container cover cannot be easily removed once installed. This structure creates an assembly problem in that the container cover must be open in order to fill the container with the cosmetic substance. The open container cover, however, causes the case to incline as a result of a shifted center of gravity. As a result, the cosmetic material filling operation and equipment must be designed in a way that counteracts the tendency of the cosmetic case to incline.

Furthermore, in regard to a cosmetic case with an inner container cover as described above, it is desirable to close the container cover as soon as the cosmetic material is placed in the container tray due to the high rate of evaporation of the cosmetic material. Because the container tray and container cover are provided as separate components, it becomes necessary to first fill the container tray, then assemble the tray to the cosmetic case, install the container cover, and finally close the cover. This poses a manufacturing problem in that the cosmetic material must remain exposed during various assembly stages. Moreover, a temporary cover is often installed over the container tray in order to seal the cosmetic material during assembly. The aforesaid shortcomings have the effect of not only complicating, but increasing the cost of the cosmetic case manufacturing and assembly operation.

All of the cosmetic cases discussed above provide a structure in which the interior of a vertically oriented rectangular cosmetic case is divided into a front compartment for cosmetic material storage and a rear compartment for storage of a cosmetic applicator tool. Furthermore, a latch mechanism is installed at the front extremity of the case and a main hinge at the rear extremity. Excessive mechanical play can be generated in the latch mechanism as a result of variances in component dimensions and assembly tolerances, thus allowing the front of the case cover to float upward and prevent the formation of an effective atmospheric seal between the case cover and case.

As previously discussed, accessing the cosmetic material inside the case involves a process in which you must release the latch mechanism, open the case cover, release the container case latch mechanism, and finally open the container cover. The necessity to open two separate latch mechanisms makes operation of the case unduly awkward and time consuming.

Moreover, the use of two separate latch release mechanisms increases the number of cosmetic case components, thus lengthening and complicating the assembly process as well as raising costs.

SUMMARY OF THE INVENTION

One purpose of the invention is to provide for a cosmetic case wherein the case cover and container cover do not overlap, and wherein the container cover does not open and block the cosmetic applicator tool storage compartment.

A further purpose of the invention is to provide for an improved filling process through which the cosmetic container is filled with the cosmetic material, and an improved assembly process for the entire cosmetic case.

A still further purpose of the invention is to provide for improved sealing of the cosmetic container, and an improved latch mechanism that makes opening and accessing the interior of the cosmetic case more convenient.

The invention puts forth a structure for a cosmetic case wherein a wall part of a main case defines an internal space therein, and a tray part, incorporating at least a cosmetic material container part, is removably installed within the internal space. A main case cover part is pivotably attached to the rear extremity of the main case by means of a main hinge part, the case cover part being capable of closing or exposing the internal space. A main latch mechanism releaseably connects the front extremities of the main case and main case cover part, a container cover part is pivotably installed so as to be able to expose or seal the container part of the tray part, and a container hinge part detachably and pivotably connects one side of the container cover part to a side of the tray part adjacent to the container part. A container latch mechanism is installed between the container cover and tray as means of establishing a releaseable connection there between. A cutout space is formed within the wall as means of enclosing the container cover hinge part, at a point within a region extending from the main hinge to the main latch mechanism.

The tray part may be structured so as to incorporate only the container part, and the cutout space is provided as means of enclosing the container hinge part within the wall defining the container part at a point within a region extending from the main hinge to the latch mechanism but not interfering with the main hinge and main latch mechanisms.

The tray part may be structured so as to incorporate a cosmetic applicator storage compartment in front of the container part, and the cutout space may be located within the wall part defining the rearwardly disposed container part, and positioned between the main hinge and main latch mechanism but not interfering with the main hinge and main latch mechanisms.

The tray part may be structured so as to incorporate a cosmetic applicator storage compartment located behind the container part, and the cutout space may be located within the wall part defining the forwardly disposed container part, and positioned between the hinge and main latch mechanism but not interfering with the hinge and main latch mechanisms.

A single release part is provided at the front extremity of the main case as means of releasing the main latch mechanism and container latch mechanism and thereby opening both the main case cover and container cover. The single release part is comprised of a center section pivotably supported within the main case, an outwardly exposed operating part exposed at the front of the main case, and a main case cover and container cover push-up part extending rearward from the center section in the opposite direction from the operating part. As the push-part is pivotably supported, it is able to movably contact and push up against the main case cover and container cover.

The push-up part incorporates a separate case cover push-up part and container cover push-up part, each structured so as to provide for a greater distance between the container cover and container cover push-up part than between the main case cover and case cover push-up part. This structure provides means of opening the case cover only if so desired.

Moreover, the invention provides for a structure wherein the main case cover encloses the area above the container cover, when the container cover is in a closed position, the area serving as the cosmetic applicator tool storage space.

The tray part may be pivotably installed to the main case by means of the main hinge, and a cosmetic applicator storage space may be formed under the tray part in a space defined by the main case wall.

Furthermore, the invention provides for a release part located at the front extremity of the main case. This release part is capable of releasing the connection established by the main latch mechanism.

The release part is integrally formed to the tray part, incorporates left and right arm parts adjacently formed thereon, and is capable of moving in a fore-aft direction by means of the tensile distortion characteristic provided by the arm parts. The release part is outwardly exposed at the surface of the main case and is able to move rearward as means of contacting and pushing upward on the main case cover.

The invention also puts forth a structure for a cosmetic case wherein a wall part of a main case defines an internal space therein, and a main case cover part is able to close or expose the internal space by means of rotatable attachment to the rear extremity of the main case through a main hinge. A main latch mechanism is installed between the forward extremities of the main case and case cover part, said main latch mechanism being capable of holding the case cover part closed against the main case, and a sealable refill container is removably installed within the internal space.

The sealable refill container is comprised of a main body part to which a cosmetic material holding container part is formed therein, a container cover part capable of atmospherically sealing or exposing the contents of the container part by means of a detachable container hinge part, and a container latch mechanism provided between the extremities of the container part and main body part and opposite to the container hinge part.

A cutout space, formed within the wall part at a point located within a region extending from the main hinge to the main latch mechanism, is provided as means of enclosing the container hinge part.

The internal space may also be integrally formed within the main case, the sealable refill container removably installed within the internal space, and the cutout space formed within the wall defining the internal space at a location that does not interfere with the main hinge and main latch mechanisms.

A divider wall may be provided as means of dividing the internal space into front and rear compartments, the rear compartment providing space for the removable installation of the sealable refill container. The cutout space is formed only in the rear compartment wall at a point within a region extending from the rear compartment wall through the divider wall at a location that does not interfere with the main hinge.

Moreover, a divider wall may be provided as means of dividing the internal space into front and rear compartments, the front compartment providing space for the removable installation of the sealable refill container. The cutout space is formed only within the front compartment wall at a point within a region extending from the front compartment wall through the divider wall at a location that does not interfere with the main latch mechanism.

Furthermore, the invention provides for a single release part installed at the front extremity of the main case, the single release part providing means of opening both the main case cover and container cover by releasing both the main latch mechanism and the container latch mechanism.

The single release part is comprised of a pivotably supported center section to the main case, a forward extending operating part outwardly exposed at the external surface of the main case, and a push-up part extending rearward from the center section. As the push-up part is pivotably supported through the center section, the push-up part is capable of pivotably contacting both the main cover and container cover as means of pushing up and opening the covers.

The push-up part incorporates a separate case cover push-up part and container cover push-up part, and is structured so as to provide for a greater distance between the container cover and container cover push-up part than between the main case cover and case cover push-up part as means of opening the case cover first.

Moreover, the invention provides for a structure wherein a cosmetic applicator tool storage space is formed above the refill container cover by means of the main case cover enclosing the space above the container cover.

A mid-frame part may be pivotably installed within the main case by means of the main hinge part, and the sealable refill container may be removably installed to the mid-frame part within the internal space of the main case. A cosmetic applicator tool storage space is formed below the mid-frame part by means of the main case walls enclosing the space below the mid-frame.

The invention provides for a hinged container cover that prevents evaporation of the cosmetic material, a cutout space in which the container hinge is housed, and a structure whereby the cutout space can be located in an area between but avoiding the main hinge and main latch mechanism. As a result of these structures, the container cover does not overlap the underside of the main case cover, to which a mirror is attached, when both covers are open, thus allowing the complete mirror surface to be exposed, and the container cover to open to a wider angle to allow for more convenient access to the cosmetic material.

When the container and container cover are located at the rear part of the main case, and the cosmetic applicator space at the front part, the container cover, when opened, does not cover nor interfere with the cosmetic applicator space. Moreover, mechanical play in the main latch mechanism will not affect the effectiveness of the seal formed between the container cover and container.

As the cutout space provides an internal housing for the container hinge, the portion of the container hinge protruding upward from the main case wall can be significantly reduced, thus allowing the thickness of the cosmetic case to be reduced.

Moreover, the invention provides for a detachable type hinge mechanism between the container cover and tray, or between the container cover and sealable refill container. This type of hinge structure allows for an assembly process in which the container tray or refill container, with cover detached, can be separated from the main case when filled with a cosmetic material. The container cover can then be easily installed and the container tray or refill container inserted into the main case. Because the container cover can be attached and closed immediately after filling the tray container or refill container with the cosmetic material, a means of preventing evaporation of the cosmetic material during the cosmetic case assembly process is provided. Because the tray container or refill container can be filled while the container cover detached, the center of gravity of the container is not upset so the container remains flat on its support surface, thereby providing for a smoother and more trouble-free cosmetic filling process. Moreover, this structure makes it possible for any number of tray containers or refill containers to be handled and/or stored already filled with cosmetic material. The cosmetic case assembly process is also improved as the cosmetic filled tray container or refill container can be simply and quickly inserted into the main case with a simple push-in operation. The need to install a temporary cover to seal the cosmetic material during the assembly process is eliminated. Moreover, the cosmetic filled tray container can be equipped with various styles of container covers to match the design of the main case, and the refill containers can be distributed as separate products in themselves. The aforesaid factors also help to lower the manufacturing cost of the cosmetic case.

The cosmetic case becomes more convenient to use as a result of the single release part that releases both the main latch mechanism and the container latch mechanism, thus providing a structure that allows both covers to be opened through a single latch operation.

Moreover, as the invention provides for a latch release push-up part incorporating two separate push-up parts to push-up the main case cover and container cover respectively, a different stroke length can be established as means of opening the main case cover only. That is, if access to the mirror only is desired, the push-up part can be partially moved only to the extent that releases the main latch mechanism to open the main case cover, without opening the container cover.

The invention also provides for a structure wherein a tray or mid-frame to which the refill container can be installed, is pivotably installed within the main case, and a cosmetic applicator storage space is formed beneath the tray or refill container. The cosmetic applicator storage space may also be provided on the container case within the main case. This structure allows the tray or refill container to be located in an overlapping position above or below the cosmetic applicator storage space, thus allowing the external dimensions of the cosmetic case to be made more compact.

The invention also provides for a main latch mechanism release part that makes use of its own temporary tensile deformation characteristic to return automatically to its rest position after being depressed to open the case cover. This release part is integrally formed as part of the tray, and provides the advantages of reducing the number of components needed to assemble the cosmetic case and simplifying the assembly process.

DESCRIPTION OF THE PREFERRED EMBODIMENT

Figure 1:
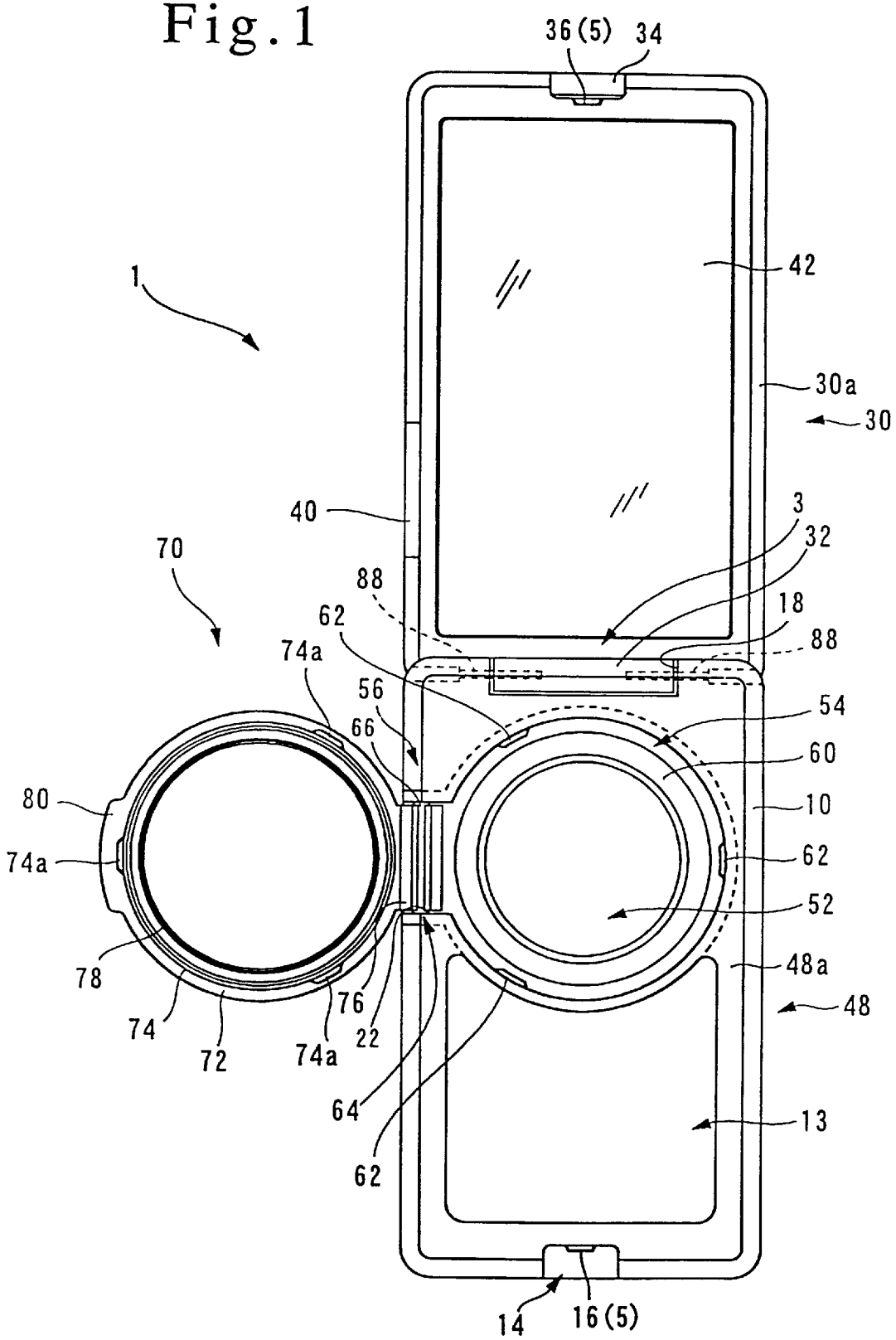
FIG. 1 is a plan view of the first embodiment of the invention with the container cover in an open position.
Figure 2:
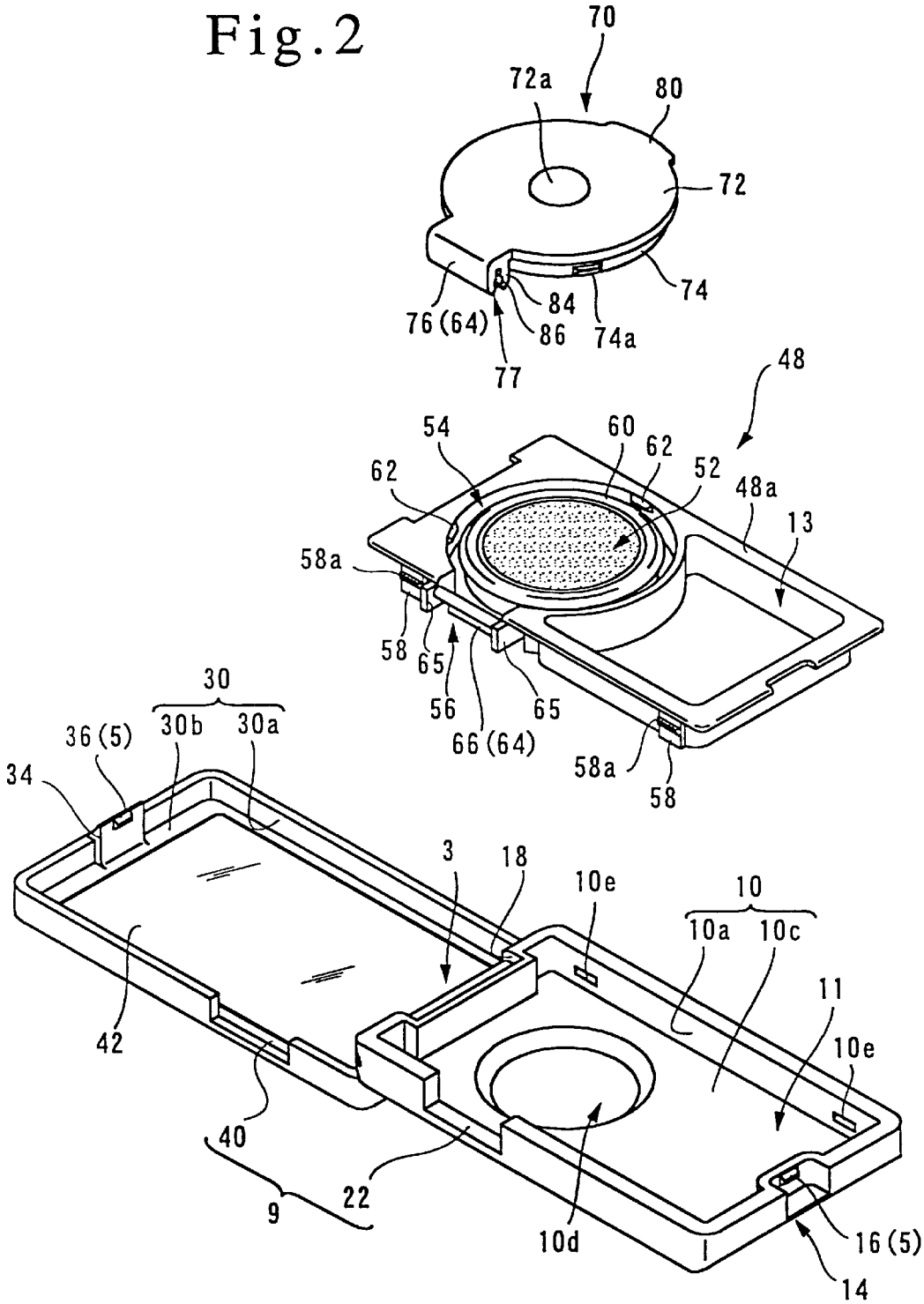
FIG. 2 is an oblique exploded view of the main structures of the first embodiment.
Figure 3:
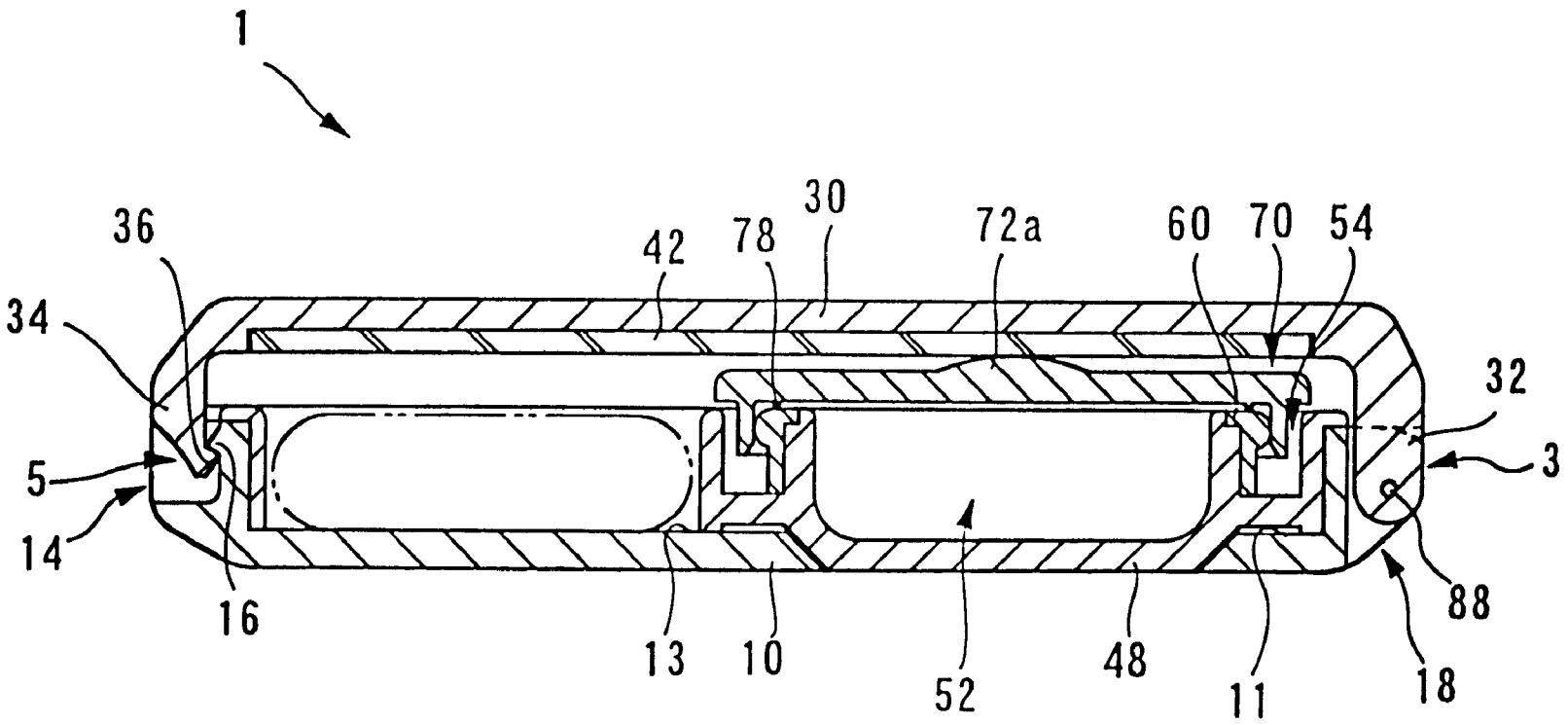
FIG. 3 is a lateral cross sectional view of the first embodiment.
Figure 4:
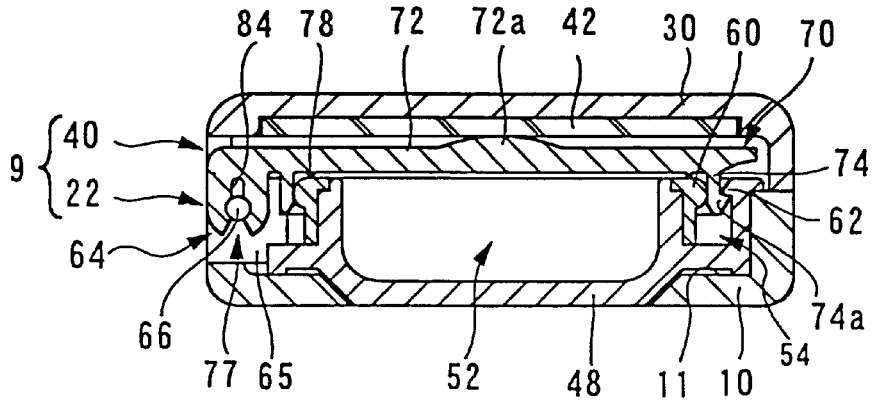
FIG. 4 is a front cross sectional view of the first embodiment.
Figure 5:
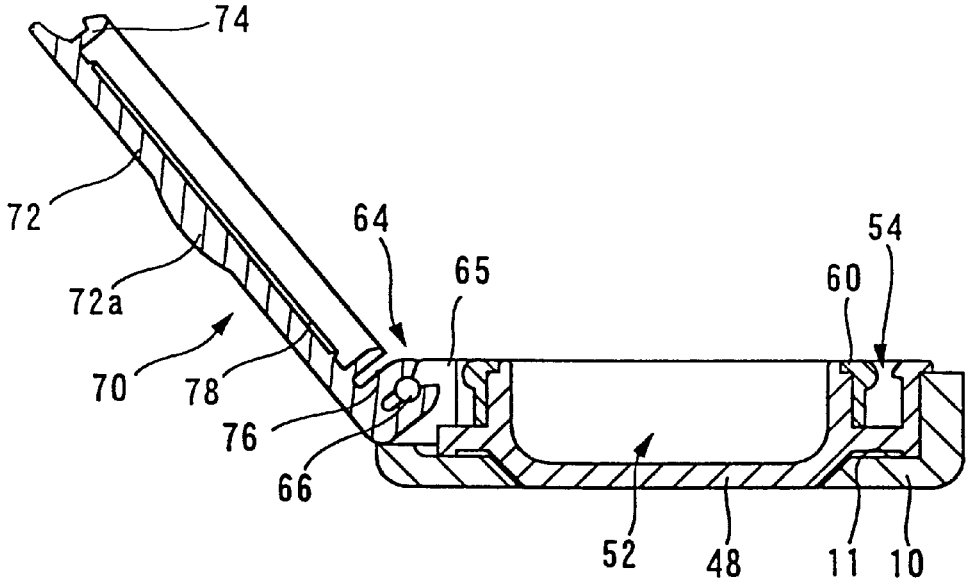
FIG. 5 is a front cross sectional view of the first embodiment with the container cover in an open position.
Figure 6:
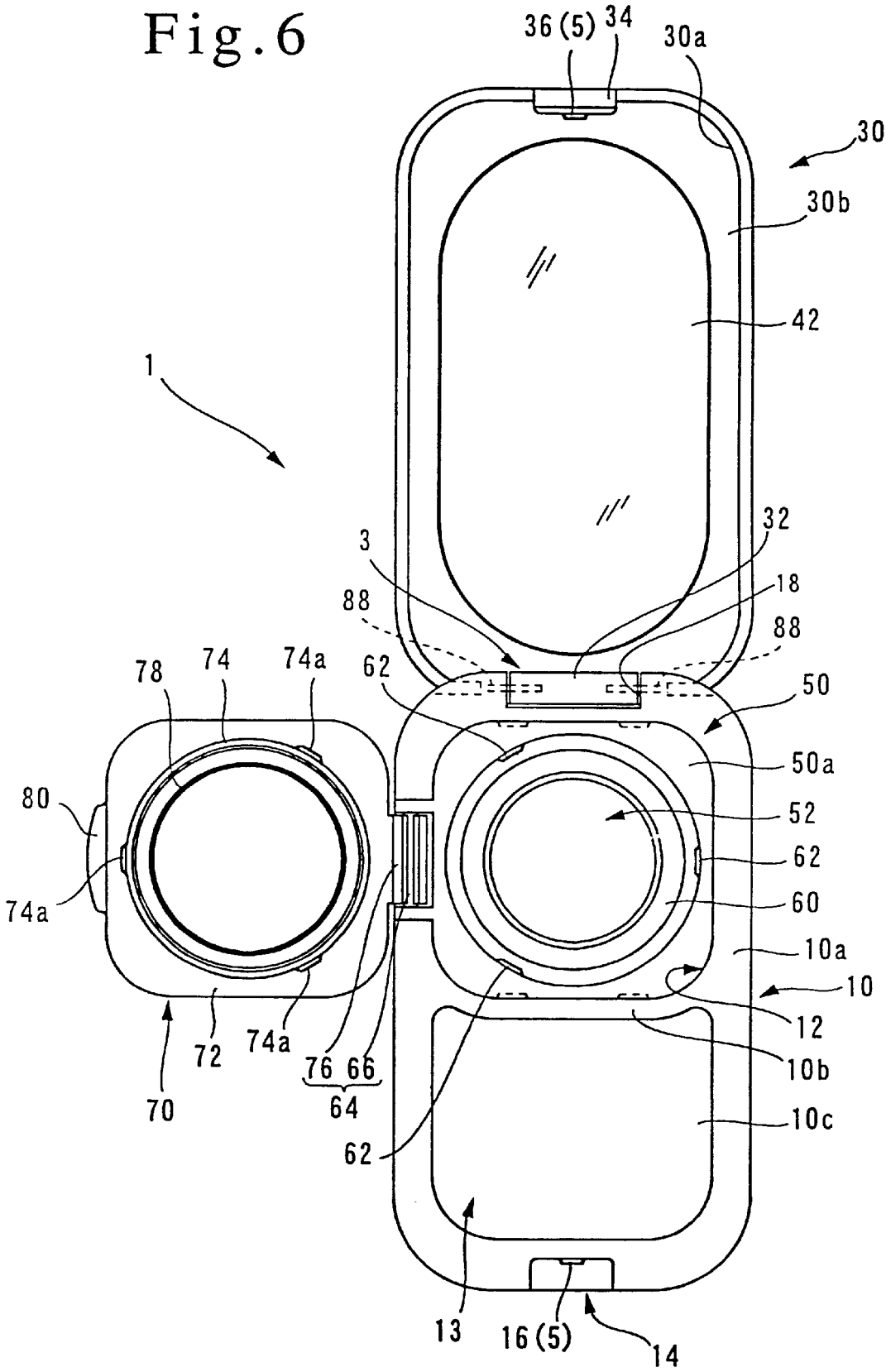
FIG. 6 is a plan view of the second embodiment of the invention with the case cover and container cover in an open position.
Figure 7:
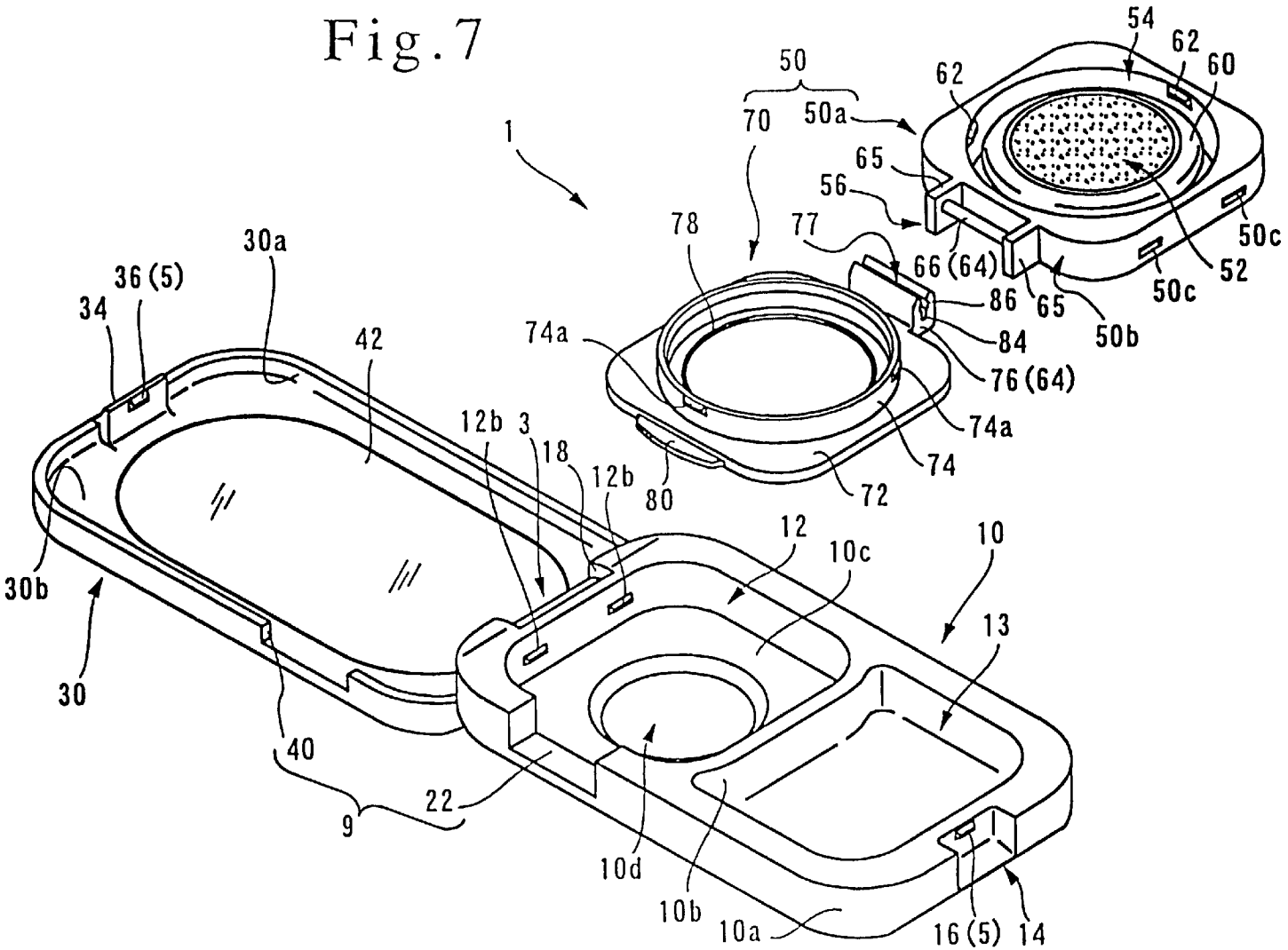
FIG. 7 is an oblique exploded view of the main structures of the second embodiment.
Figure 8:
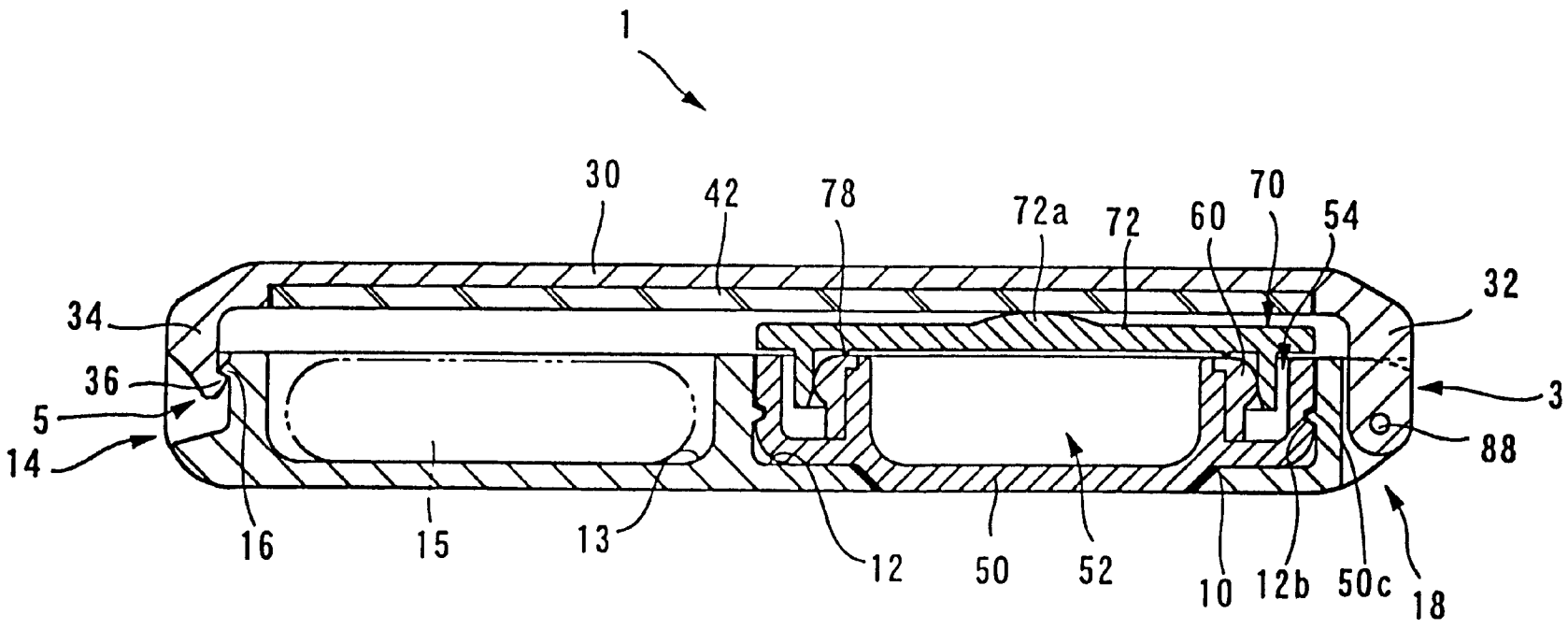
FIG. 8 is a lateral cross sectional view of the second embodiment.
Figure 9:
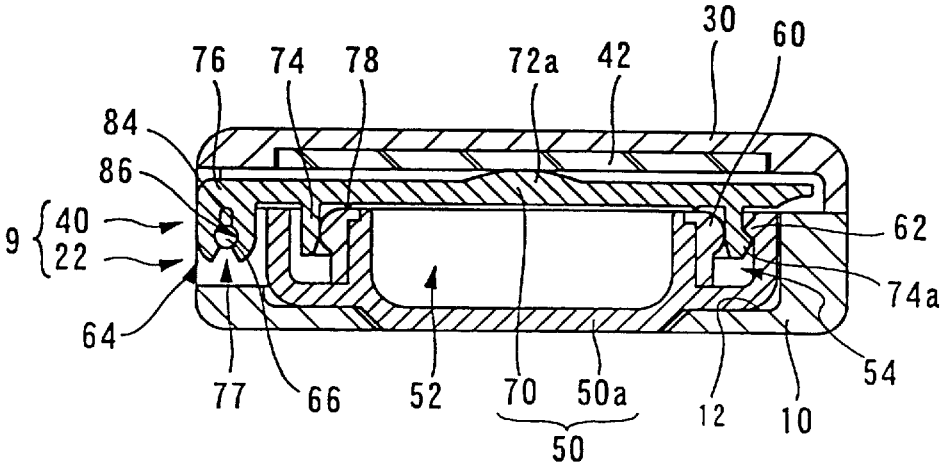
FIG. 9 is a front cross sectional view of the second embodiment.
Figure 10:
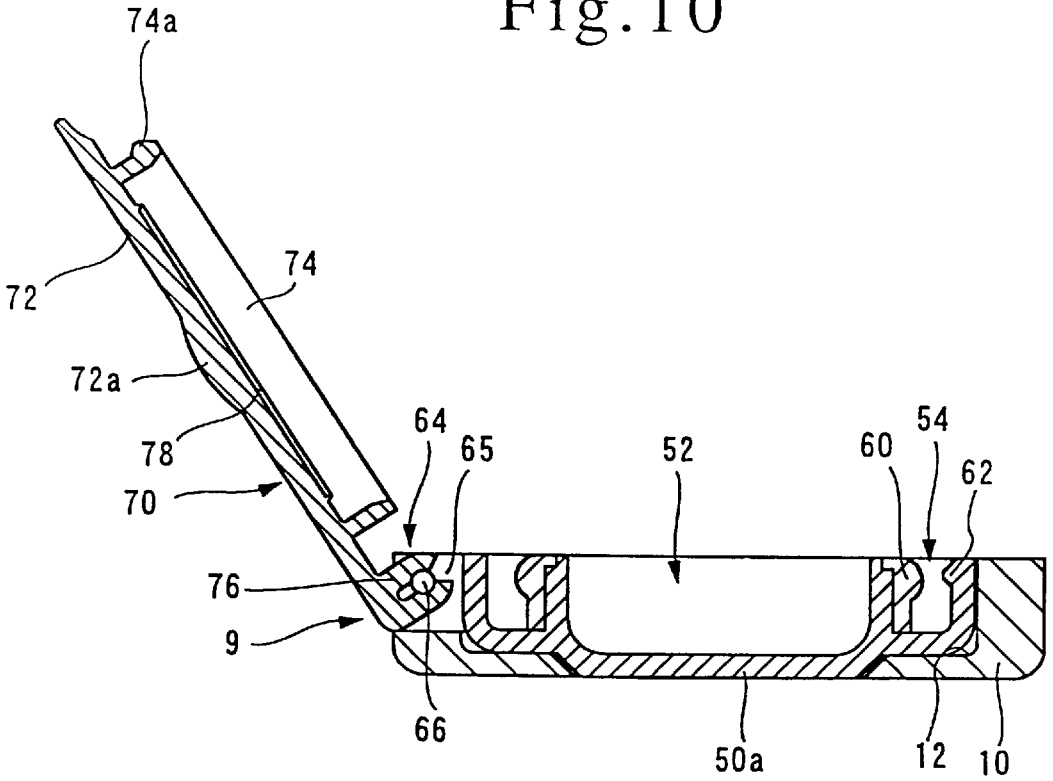
FIG. 10 is a front cross sectional view of the second embodiment with the container cover in an open position.
Figure 11:
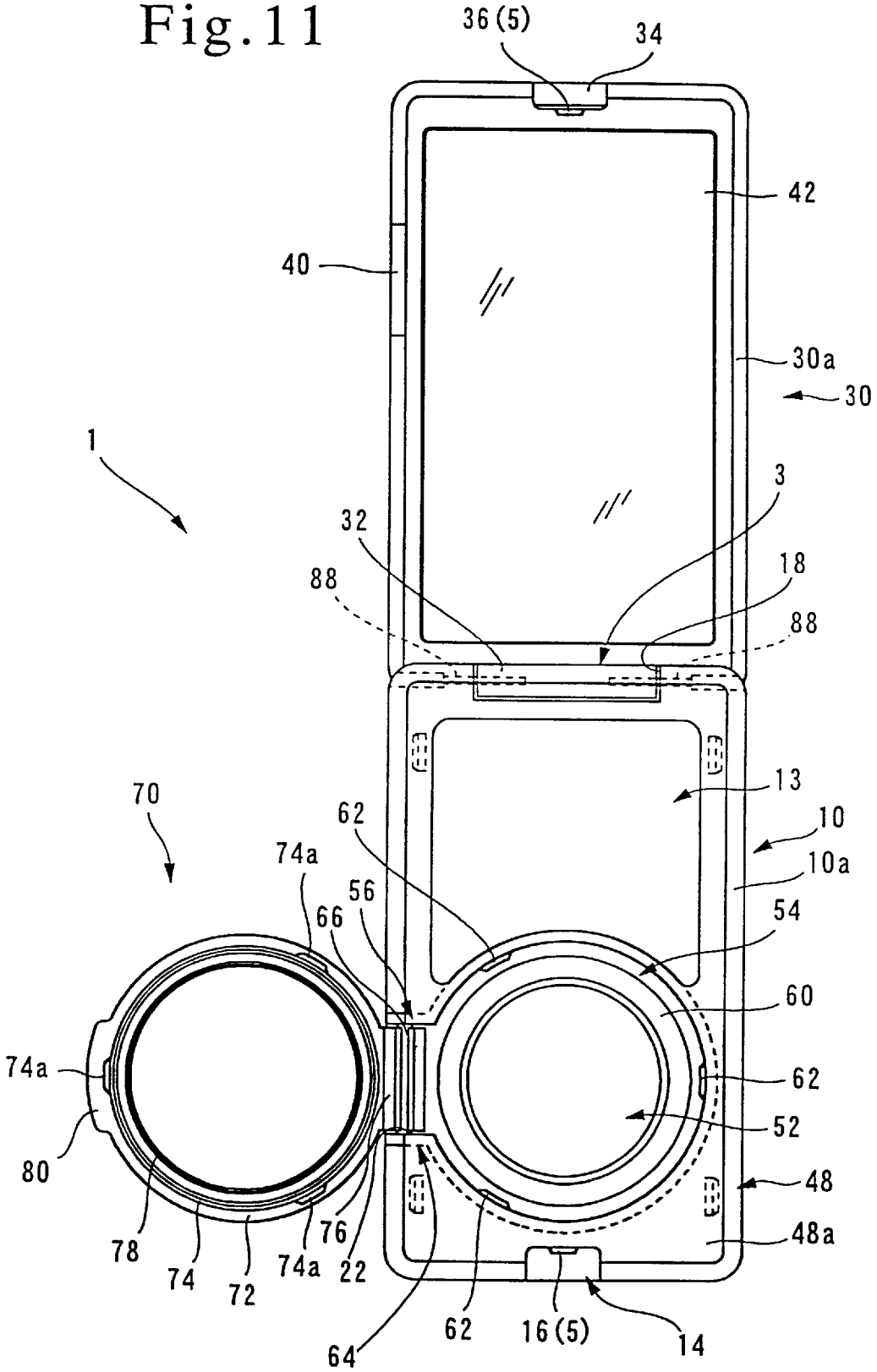
FIG. 11 is a plan view of the third embodiment of the invention with the container cover in an open position.
Figure 12:
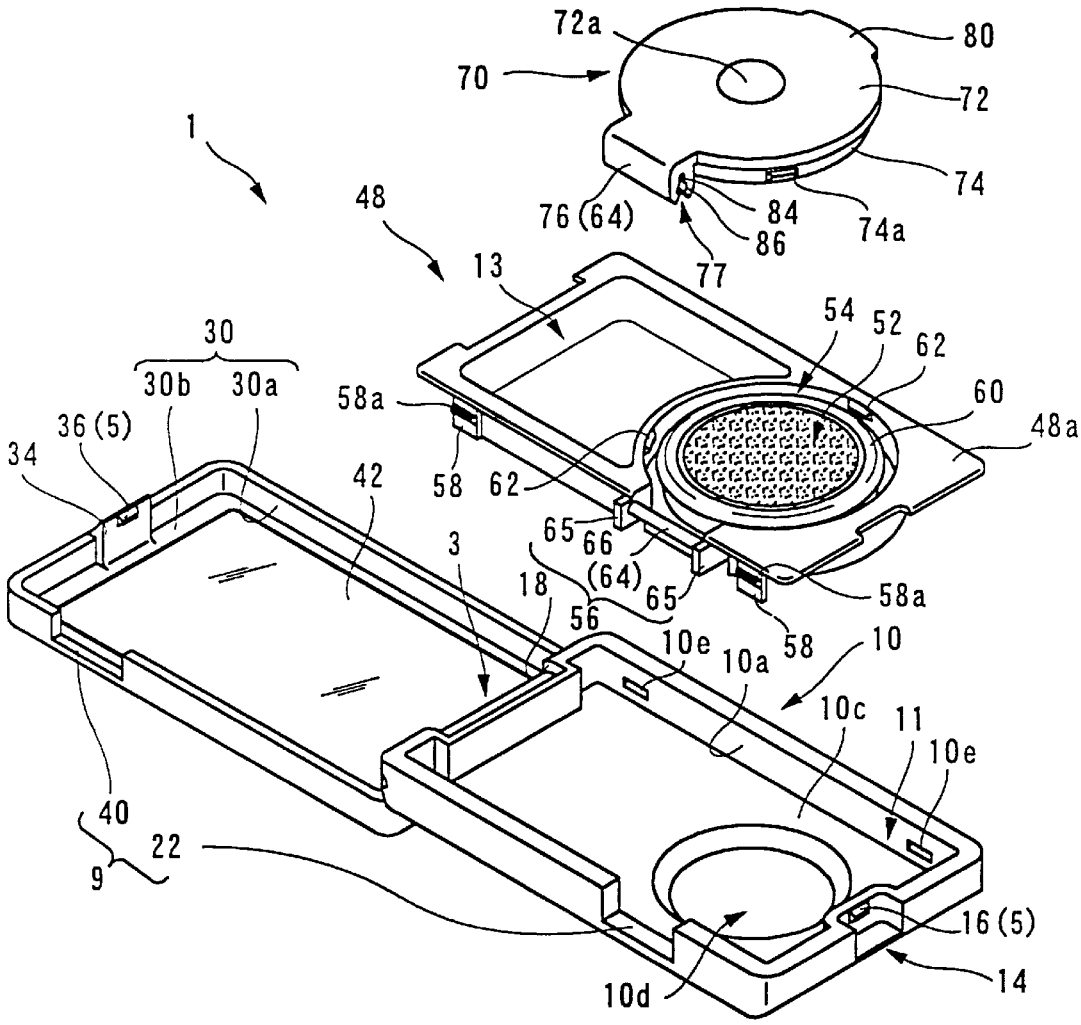
FIG. 12 is an oblique exploded view of the main structures of the third embodiment.
Figure 13:
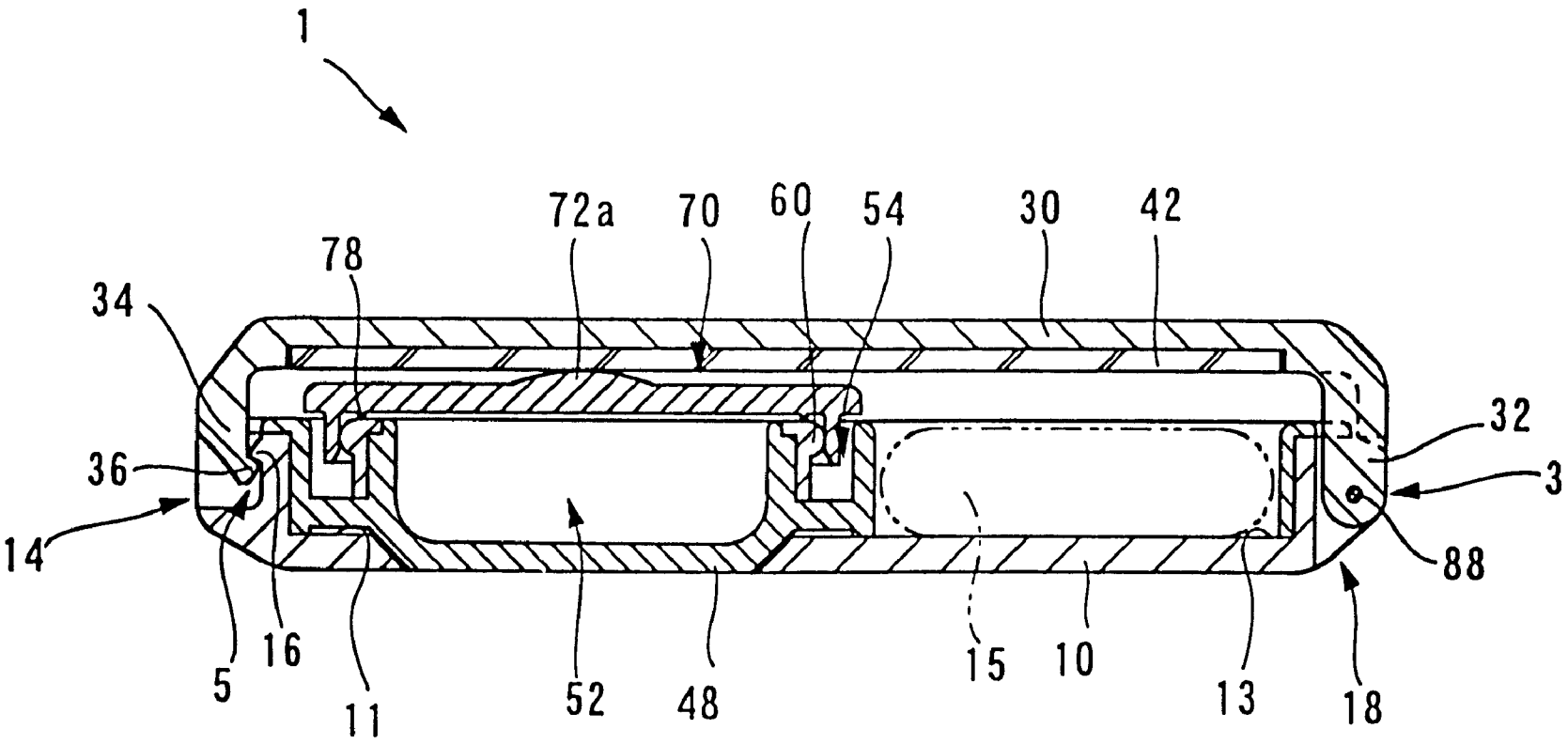
FIG. 13 is a lateral cross sectional view of the third embodiment.
Figure 14:
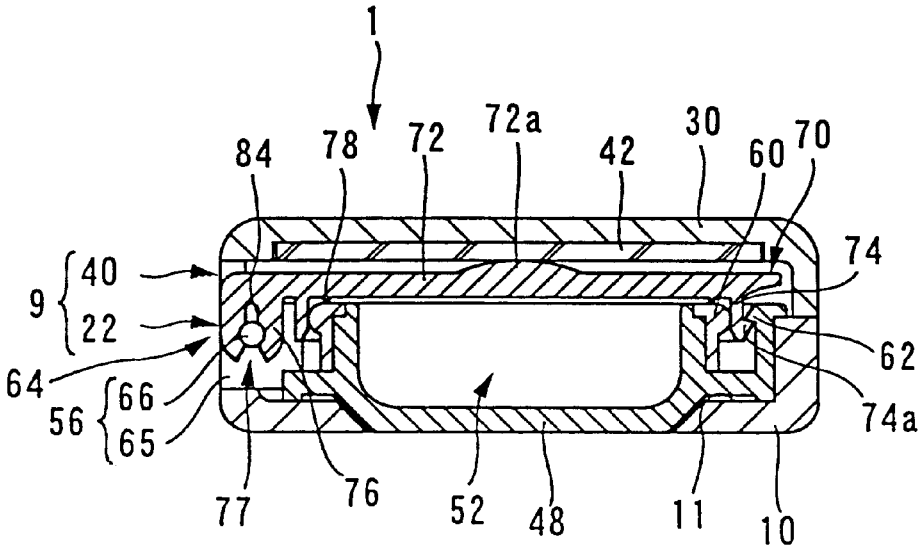
FIG. 14 is front cross sectional view of the third embodiment.
Figure 15:
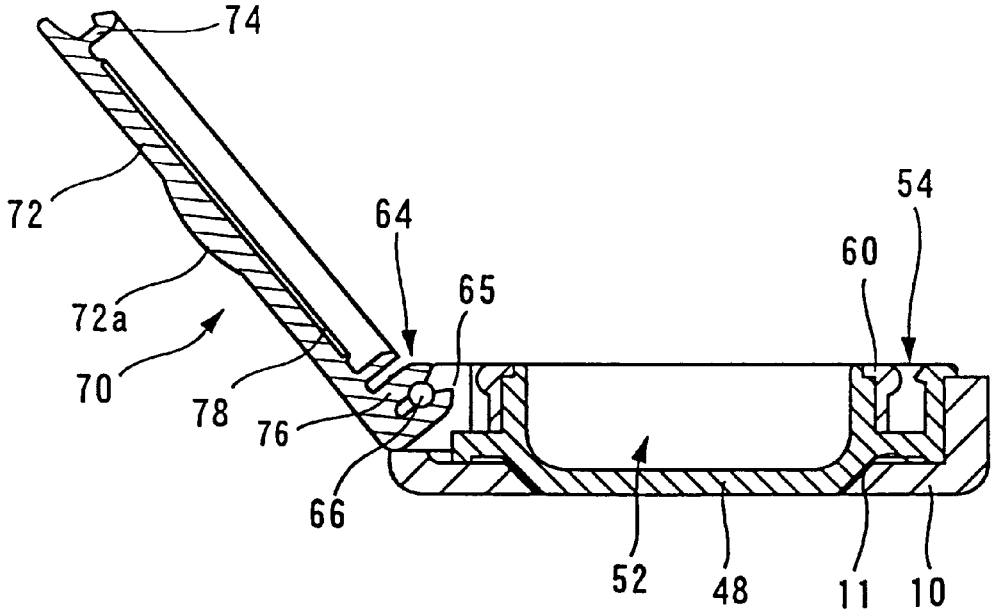
FIG. 15 is a front cross sectional view of the third embodiment with the container cover in an open position.
Figure 16:
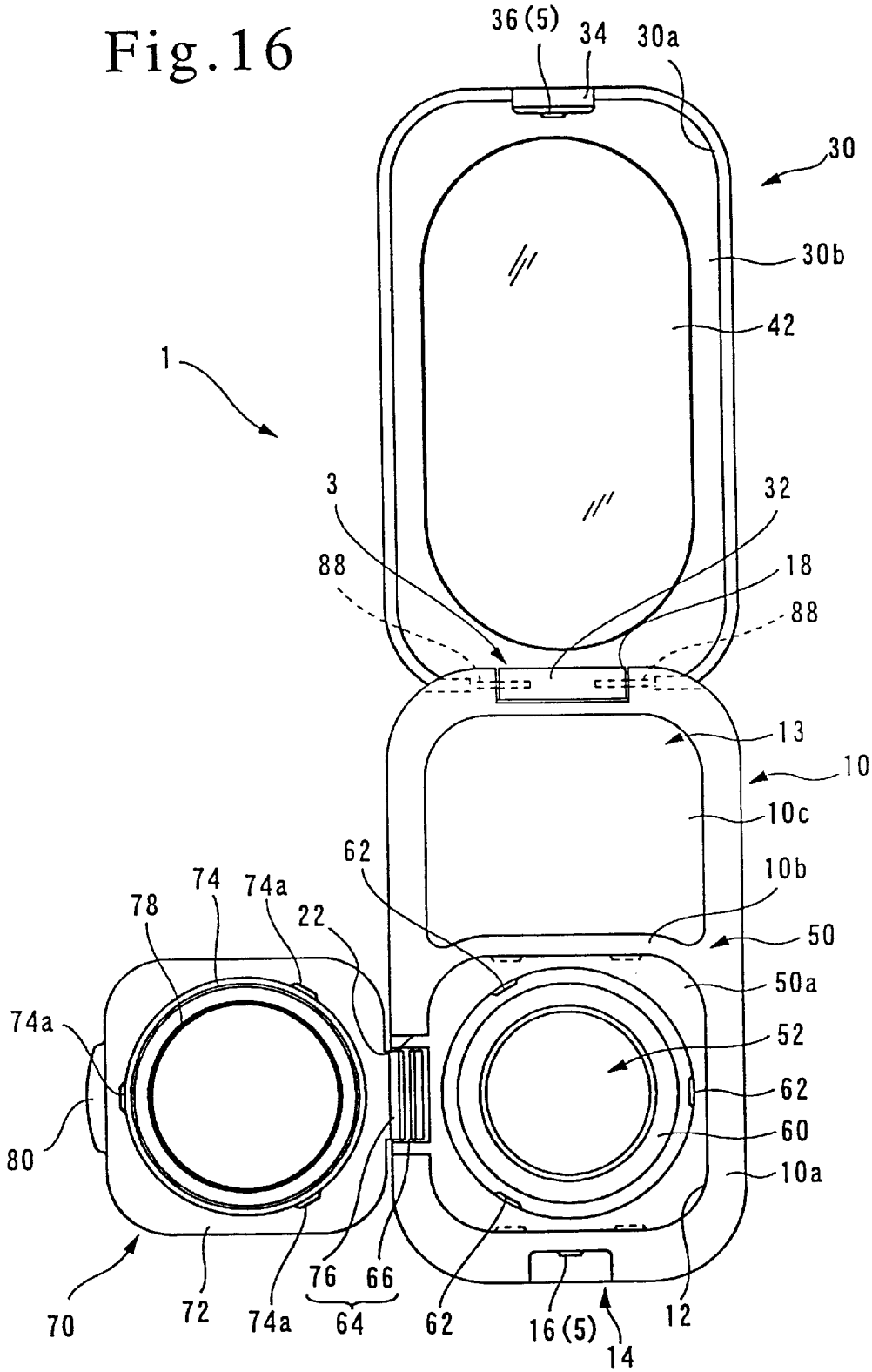
FIG. 16 is a plan view of the fourth embodiment of the invention with the case cover and container cover open in an open position.
Figure 17:
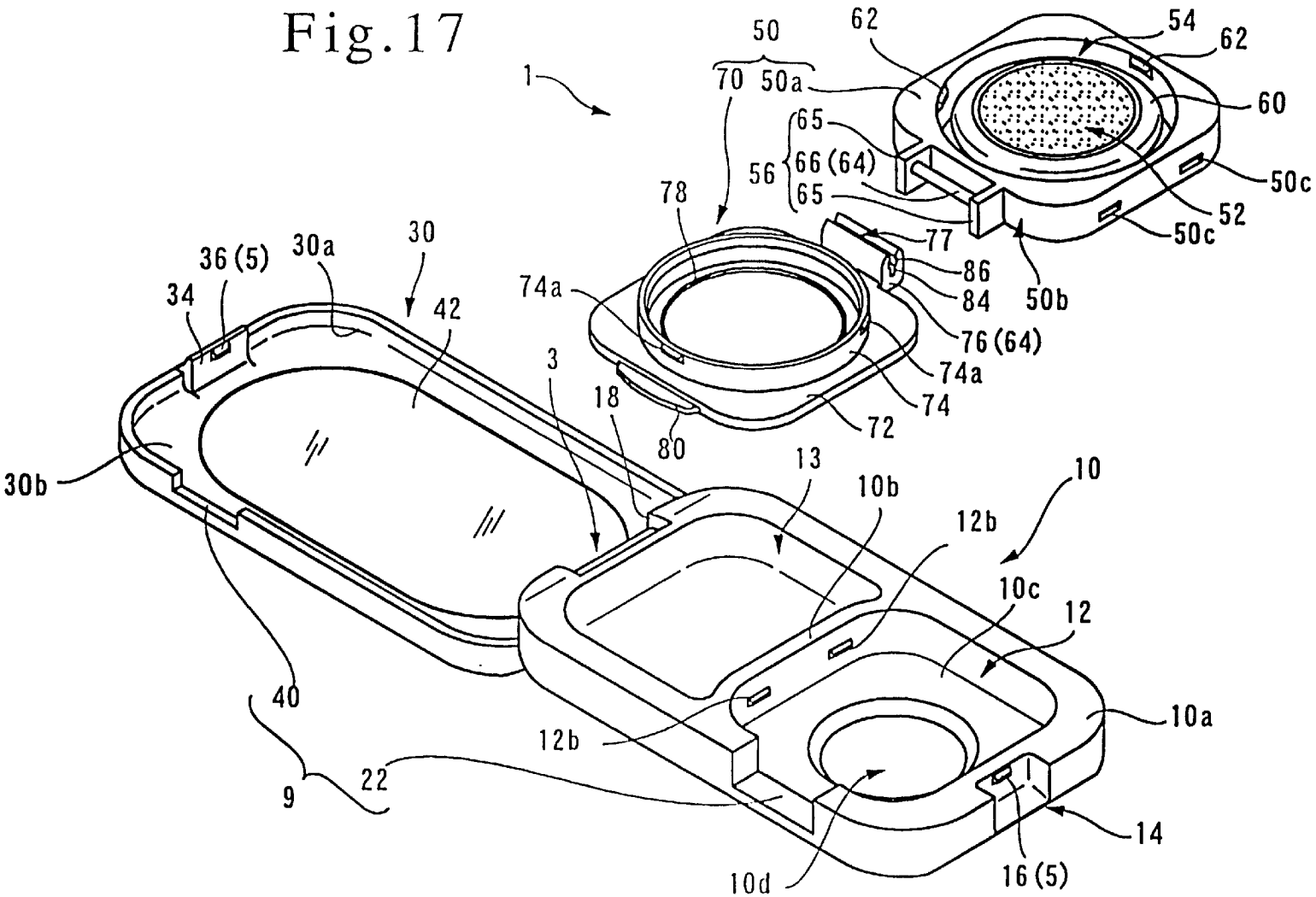
FIG. 17 is an oblique exploded view of the main structures of the fourth embodiment.
Figure 18:
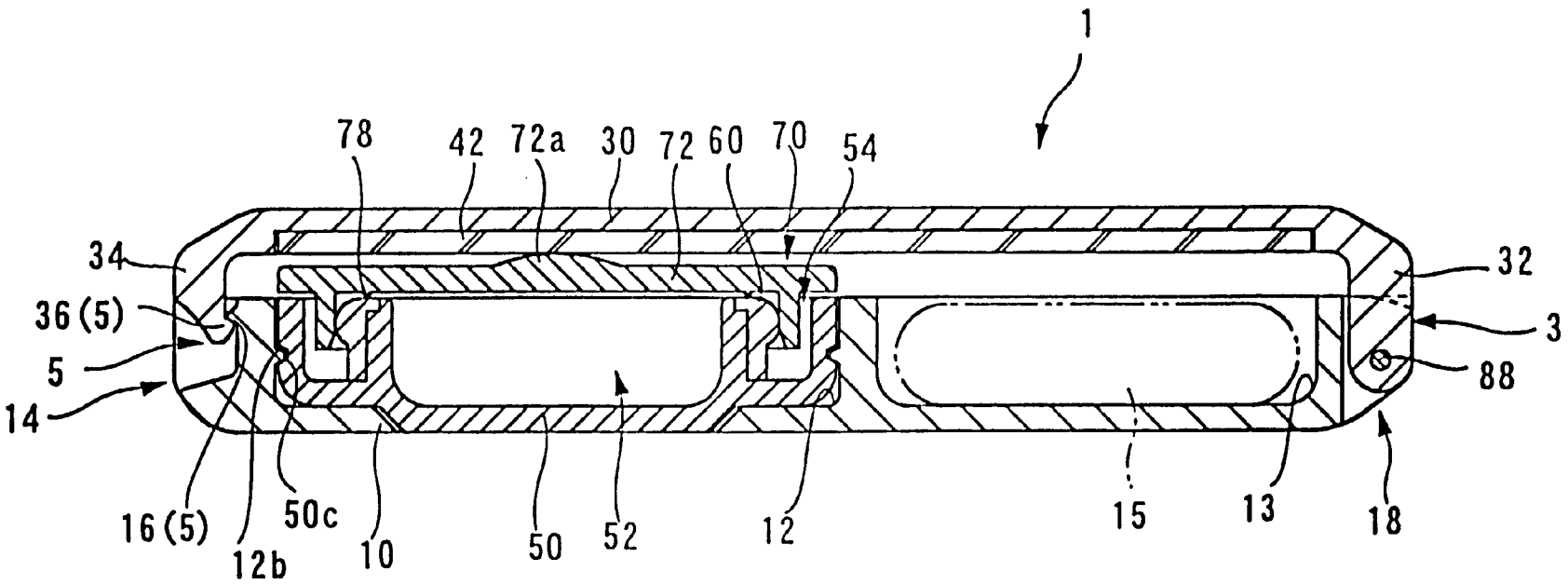
FIG. 18 is a lateral cross sectional view of the fourth embodiment.
Figure 19:
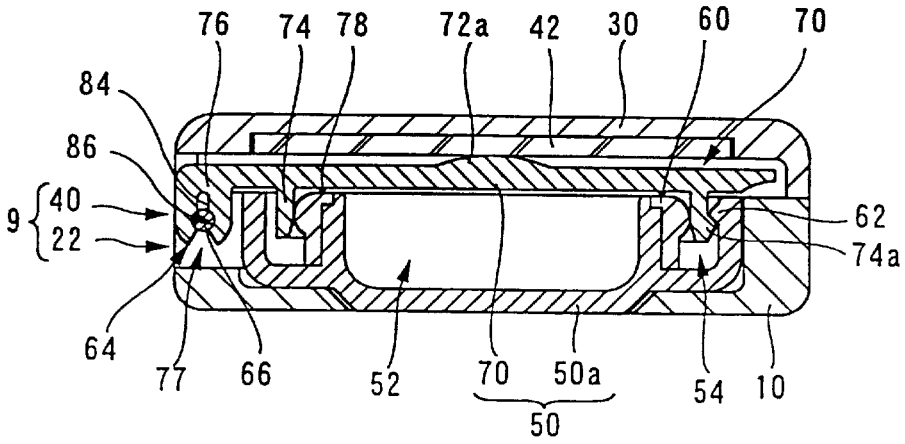
FIG. 19 is a front cross sectional view of the fourth embodiment.
Figure 20:
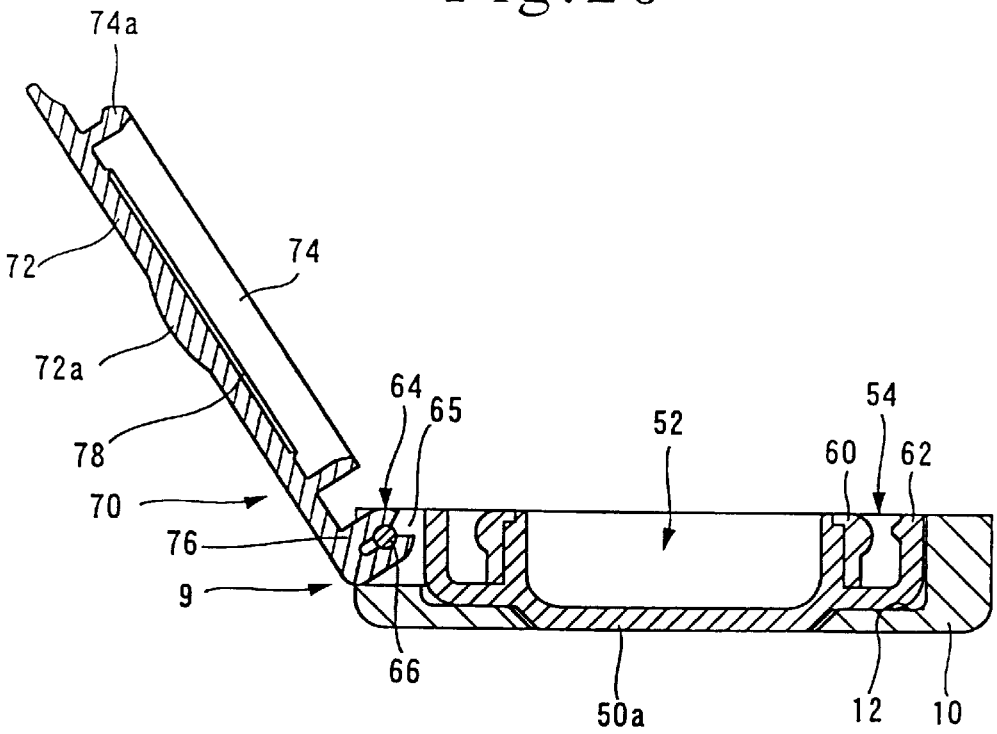
FIG. 20 is a front cross sectional view of the fourth embodiment with the container cover in an open position.
Figure 21:
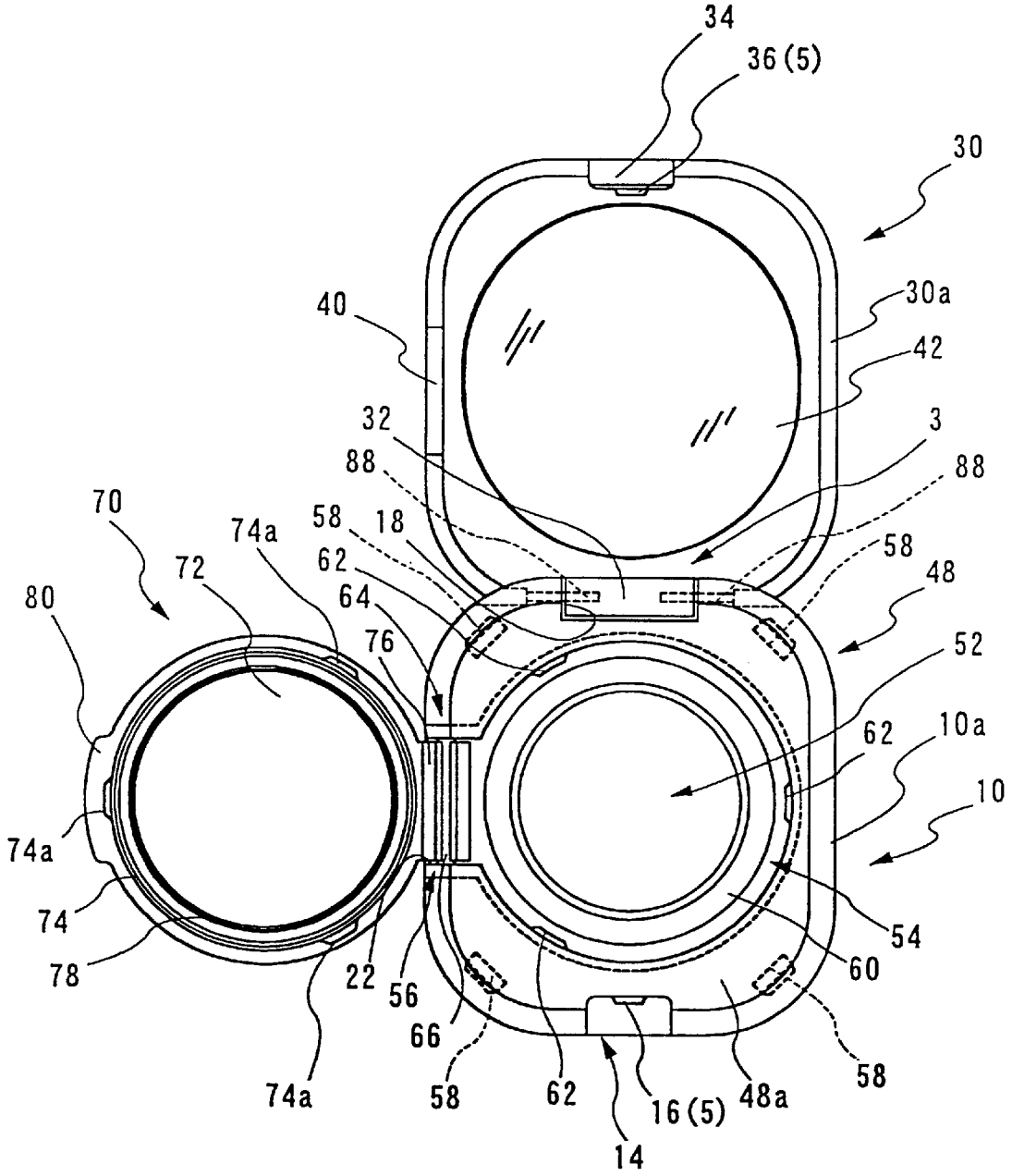
FIG. 21 is a plan view of the fifth embodiment of the invention with the case cover and container cover in an open position.
Figure 22:
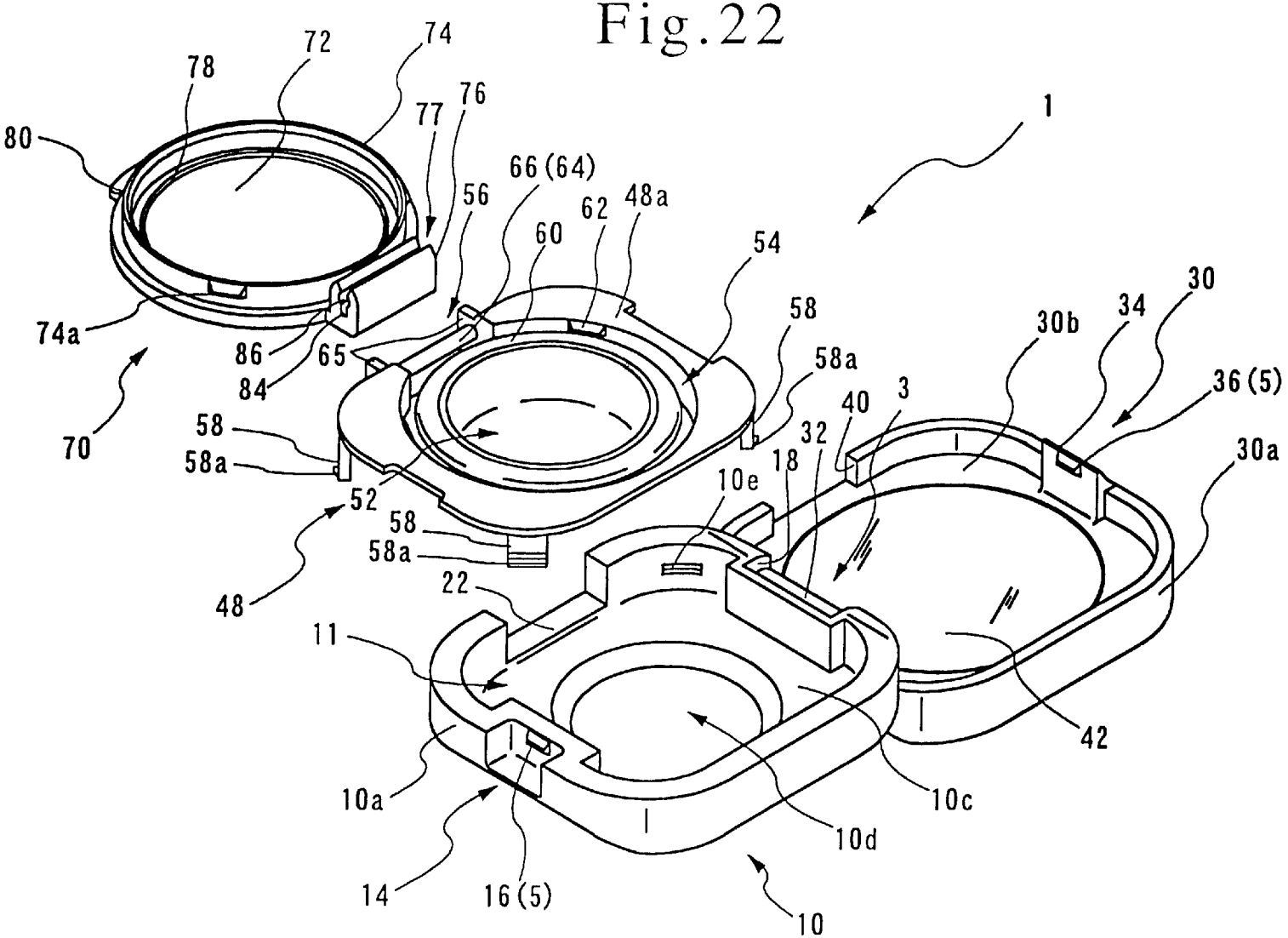
FIG. 22 is an oblique exploded view of the main structures of the fifth embodiment.
Figure 23:
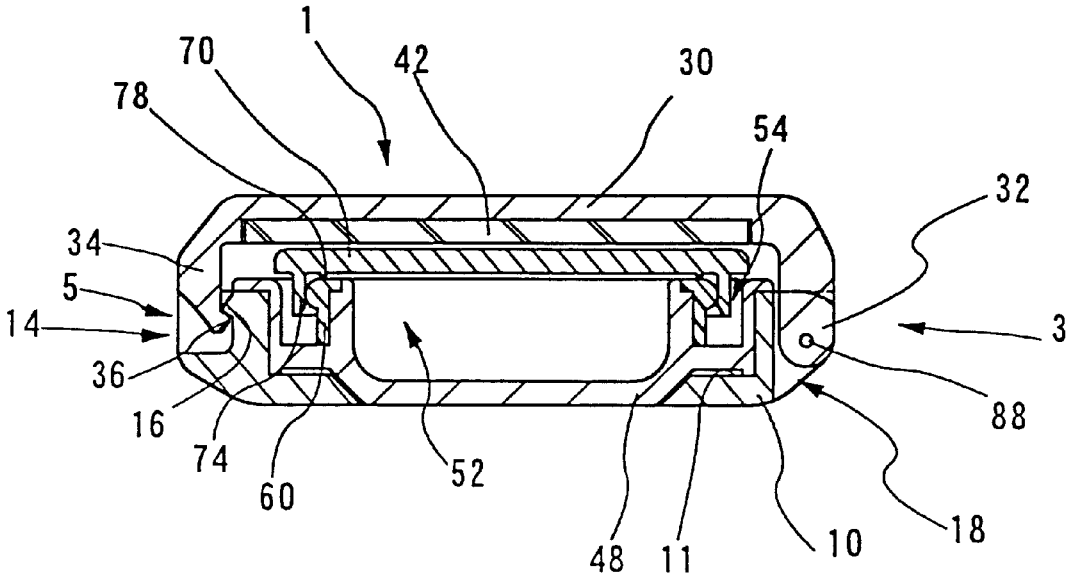
FIG. 23 is a lateral cross sectional view of the fifth embodiment.
Figure 24:
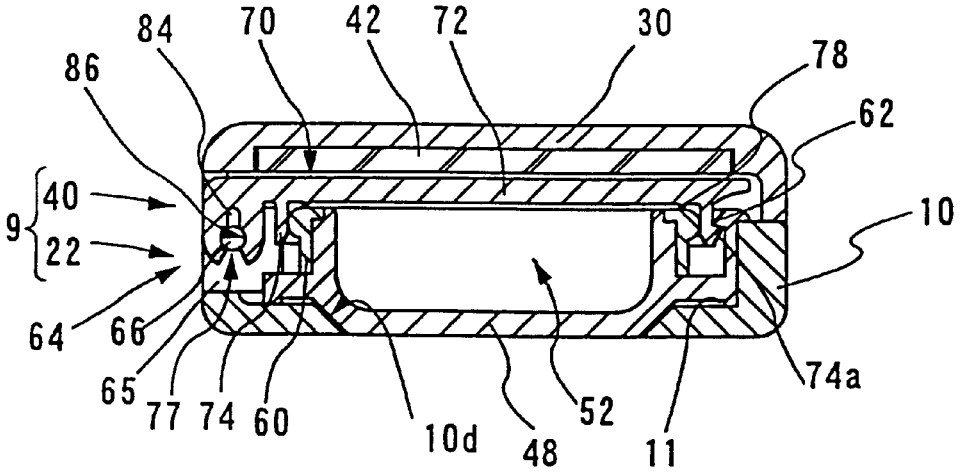
FIG. 24 is a front cross sectional view of the fifth embodiment.
Figure 25:
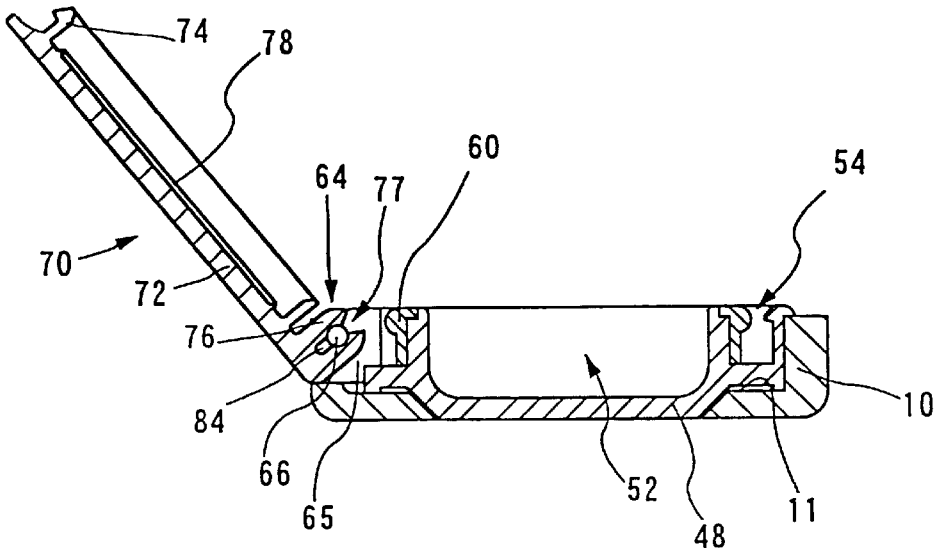
FIG. 25 is a front cross sectional view of the fifth embodiment with the container cover in an open position.

The following discussion will provide an explanation of various embodiments of the invention with reference to the attached figures.

FIGS. 1 through 5 put forth the invention as cosmetic case 1, said case being principally comprised of long rectangular main case 10, main case cover 30 to which mirror 42 is installed, container tray 48 to which container 52 is installed, and container cover 70.

Main case 10 is formed as a relatively long rectangular shape vertically oriented in a fore-aft direction as shown in FIG. 1. Internal space 11 is defined by perimeter wall 10*a* and floor 10*c* formed within main case 10. Case notches 10*e* are formed within perimeter wall 10*a* as means of securing container tray 48 within main case 10. Orifice 10*d* is provided at the rear area of floor 10*c* to accommodate container 52 as means of increasing the volume of said container. Latch cutout 14 is formed at the center and within the forward facing surface of main case 10, and latch lip 16 is provided within latch cutout 14. Hinge cutout 18 is formed at the center and within the rear facing surface of main case 10 as means of accommodating case hinge 3.

Cutout space 22, formed through the left side of perimeter wall 10*a,* provides a passage that connects internal space 11 to the space external to main case 10.

Main case cover 30 incorporates perimeter wall 30*a* which is formed to the same contour as perimeter wall 10*a* of main case 10. Mirror 42 is installed to underside 30*b* of cover 30. Main hinge boss 32 is formed as an extension of the rear part of main cover 30 and inserts into hinge cutout 18 in main case 10 to form case hinge 3. Latch 34 is provided on the front extremity of main case cover 30, and incorporates latch finger 36 which releaseably joins to latch lip 16 provided within latch cutout 14, thus forming main latch mechanism 5. Cutout space 40 is formed within the left side of perimeter wall 30*a* of cover 30 directly opposed to cutout space 22, thus forming an orifice exposing the interior of main case 10 when main case cover 30 is closed.

Cosmetic container 52 and cosmetic applicator tool storage compartment 13 are integrally formed within tray frame 48*a,* tray frame 48*a* having the same shape as perimeter wall 10*a* of main case 10. Cosmetic container 52 is formed to a round shape and located within the rear area of tray frame 48*a,* and storage compartment 13 is formed within the front area of tray frame 48*a*. Circular sealing grove 54 is provided around the periphery of cosmetic container 52, and container hinge support 56 is provided at the left side of cosmetic container 52. Tray bosses 58 are formed on the outward facing surfaces of tray frame 48*a* directly opposite to case notches 10*e*. Tabs 58*a* are formed on tray bosses 58 and insert into case notches 10*e* as means of securing tray 48 within internal space 11. Sealing ring 60 is installed within circular sealing groove 54 and presses radially inward against the periphery of container 52. Lock tabs 62 project inward from the outer wall of sealing groove 54 at uniform intervals, one of tabs 62 being located directly opposite to hinge support 56 across container 52. Hinge support 56 is comprised of a pair of outwardly protruding vertically oriented hinge flanges 65, and hinge pin 66 which is horizontally installed between flanges 65 so as to locate at a point beneath the upper surface of container 52.

Container cover 70 is comprised principally of cover plate 72, circular flange 74 protruding downward from the underside cover plate 72, and hinge boss 76 that pivotably connects to hinge pin 66 to form hinge structure 64. Cover bumper 72*a* protrudes from the upper surface of cover plate 72 and contacts mirror 42 when case cover 30 is closed against case 10. Circular flange 74, formed on the underside of cover plate 72, enters circular sealing groove 54 when case cover 70 is closed against main case 10. Pressure ridge 78 is circumferentially formed on the inner surface of cover plate 72 at a location concentric to and radially inward of circular flange 74, and applies pressure against sealing ring 60 when case cover 3 is closed against case 10. Hinge boss 76 is formed on the periphery of cover plate 72 and inserts between the two hinge flanges 65 so as to pivotably connect to hinge pin 66. Lift flange 80 is formed on the periphery of cover plate 72 at a location directly opposite hinge boss 76. Lock fingers 74*a* are formed around the perimeter of circular flange 74 at locations opposite to lock tabs 62 in circular sealing groove 54. Slit 77 is formed within both sides of hinge boss 76, hinge pin hole 86 is provided within slit 77 as means of pivotably connecting hinge boss 77 to hinge pin 66, and hinge grooves 84 are formed at the innermost part of slit 77 as means of aiding the expansion of slit 77 to accommodate hinge pin 66.

The aforesaid structure allows container cover 70 to pivotably open from or close against container 52 by means of the pivoting joint formed between hinge boss 76 and hinge support 56, said joint resulting from hinge holes 86 pivotably gripping hinge pin 66.

In regard to the assembly of the cosmetic case, container cover 70 is installed to hinge support 56 after container 52 is filled with the cosmetic substance, after which hinge structure 64 (formed by means of the pivoting connection between hinge boss 56 and hinge pin 66) is able to reside within hinge orifice 9 formed by the convergence of cutout spaces 22 and 40.

Main hinge structure 3 is comprised of main hinge boss 32 inserted within hinge cutout 18 of main case cover 30, and hinge pin 88 installed through hinge boss 32 and within the side walls of the hinge 18 cutout.

Tray bosses 58 form a joint with case notches 10*e* as means of securing the installation of tray 48 within internal space 11 of main case 10. When tray 48 is installed to main case 10, hinge structure 64 resides within cutout space 22, thus allowing container cover 70 to pivot open or close upon container 52. Container cover 70 is able to remain in a tightly closed position against container 52 as a result of the connection formed between lock fingers 74*a* and lock tabs 62. With container cover 70 in this closed position, circular flange 74 is in contact with the radial perimeter of sealing ring 60, and pressure ridge 78 is in contact with the upper side of sealing ring 60, thus forming a structure that maintains an effective atmospheric seal between container cover 70 and container 52. Internal space 11 is sealed when case cover 70 is closed against main case 10 through the joint formed between latch lip 16 (on main case 10) and latch finger 36 (on case cover 70). With main case 10 thus sealed, mirror 42 is applying pressure against cover bump 72*a* to assist in maintaining container cover 70 tightly against container 52. Hinge orifice 9 is formed through the convergence of cutout spaces 22 and 40 when case cover 70 is closed against main case 10.

In order to access the cosmetic material held within the cosmetic case, the user first releases main latch mechanism 5 and then rotates case cover 30 upward and rearward on case hinge 3 to expose the internal area of main case 10. Next, the user pulls upward on lift flange 80 to release the joint formed between lock fingers 74*a* and lock tabs 62 and rotate container cover 70 upward and to the right on hinge structure 64. The cosmetic material held within container 52 is thus fully exposed as container cover 70 opens in a direction toward the outside of main case 10. This first embodiment thus provides for a structure whereby container cover 70 can be easily installed to tray 48 and effectively seal the space within container 52. This embodiment further provides for a structure whereby container cover 70 can be quickly installed to tray 48, as means of preventing the evaporation of the cosmetic material, immediately after container 52 is filled with the cosmetic material. Moreover, this structure makes it possible to separately store any number of tray 48, with the cosmetic material already held in container 52, before tray 48 is installed into main case 10. Container 52 can be filled with the cosmetic material before installation of tray 48 into main case 10, thus allowing a more efficient and stable cosmetic filling operation to be executed separately from the case assembly operation. This embodiment also provides means whereby it becomes unnecessary to use a temporary sealing device to prevent evaporation of the cosmetic material during assembly of the case, thus providing means whereby assembly costs can be lowered.

Hinge orifice 9 is formed within perimeter walls 10*a* and 30*a* on a side of the cosmetic case separate from that to which case hinge 3 and main latch mechanism 5 are installed. As a result, when container cover 70 is moved to an open position it does not interfere with the view of mirror 42, nor does it covers cosmetic applicator tool storage space 13. The aforesaid placement of container cover 70 also allows it to open widely and thus provide for more convenient access to the cosmetic material held within container 52.

As hinge structure 64 does not extend above perimeter wall 10*a*, but resides within cutout space 22 inside of perimeter wall 10*a*, the thickness of the cosmetic case can be reduced, thus lowering weigh and improving is portability.

Moreover, as container cover 70 is positioned relatively close to case hinge 3, any mechanical play within main latch mechanism 5 will have no effect on container cover 70, thus providing for an effectively maintained seal of container 52.

While this first embodiment provides for a structure wherein a cosmetic material is held directly within tray 48 by means of container 52, a separate cosmetic filled container may also by placed in the space provided by container 52.

FIGS. 6 through 10 refer to a second embodiment of the invention wherein container 52 of the first embodiment is structured as removable refill container 50.

The space within main case 10 is defined by perimeter wall 10*a*, divider wall 10*b*, and floor 10*c*, divider wall 10*b* transversely dividing the space within main case 10 into compartments 12 and 13. Refill container 50 is removably installed within rear compartment 12, and a puff or other like cosmetic applicator tool 15 is stored within front compartment 13. Lock tabs 12*b* are formed on the internal wall of compartment 12 as means of securing refill container 50 within compartment 12. Orifice 10*d* is provided within floor 10*c* so that a finger can be pressed against the bottom of container 50 to forcibly push it up and out of main case 10.

Cutout space 22 is formed through the left side of perimeter wall 10*a* within compartment 12 so as to provide a passage from compartment 12 to the external space surrounding main case 10.

Refill container 50, formed to the same contour and size as compartment 12, is mainly comprised of container frame 50*a*, container 52 which is integrally formed within container frame 50*a*, container cover 70 which is capable of movably sealing or exposing container 52, and hinge support 56 which is provided as part of hinge 64 as means of pivotably supporting container cover 70. Container 52 is of round shape and integrally formed within container frame 50*a*. Circular sealing groove 54 is formed around the periphery of container 52 as means of providing space to accommodate a sealing ring. A multiple number of lock tabs 62 are formed on the outer peripheral wall of sealing groove 54 at uniform intervals, one of lock tabs 62 being positioned opposite hinge boss 56 across container 52. Sealing ring 60 is installed within circular sealing groove 54 and extends radially inward to the perimeter of container 52. Joint notches 50*c* are provided within the external vertical surfaces of refill container 50*a*, and form a releaseable joint with tabs 12*b* as means of securing refill container 50 within compartment 12. Container hinge support 56 is provided on external wall 50*b* of container frame 50*a*, hinge support 56 being comprised of a pair of vertical flanges 65 to which hinge pin 66 is installed and supported there between.

Container cover 70 is comprised of cover plate 72, circular flange 74 extending circumferentially downward from cover plate 72, and hinge boss 76 which pivotably attaches to hinge pin 66 to form hinge structure 64. Cover bumper 72*a* protrudes from the upper surface of cover plate 72 and contacts mirror 42 when case cover 30 is closed against case 10. Circular flange 74, formed on the underside of cover plate 72, enters circular sealing groove 54 when case cover 70 is closed against main case 10. Pressure ridge 78 is formed on the underside of cover plate 72 at a position concentric to and radially inward from circular flange 74, and applies pressure against sealing ring 60 when refill container cover 70 is closed against case 10. Hinge boss 76, formed on a peripheral edge of cover plate 72, includes hinge pin hole 86 to which hinge pin 66 inserts, slit 77 which provides means of guiding hinge pin 66 into orifice 86, and hinge groove 84 which aids in the expansion of slit 77 when hinge pin 66 is inserted to hole 86. Lift flange 80 is formed on the periphery of cover plate 72 at a location directly opposite hinge boss 76. Lock fingers 74*a* are formed around the perimeter of circular flange 74 at locations opposite to lock tabs 62 in circular sealing groove 54.

Joint notches 50*c* connect to lock tabs 12*b* to secure refill container 50 within compartment 12. The closure of case cover 30 against main case 10 joins cutout spaces 22 and 40 to form hinge orifice 9. Container hinge 64 provides means whereby container cover 70 can freely rotate over container 52, and lock fingers 74*a* and lock tabs 62 interlock to form a joint through which container cover 70 is securely held closed over container 52. With container cover 70 maintained in this closed position, the inner periphery of circular flange 74 is placed in contact with the outer periphery of sealing ring 60, and circular pressure flange 78 is placed in contact with the upper surface of sealing ring 60, thereby forming a structure whereby the contents of container 52 are sealed from the atmosphere. Case cover 30 is held closed against main case 10 by means of latch finger 36 on case cover 30 connecting to latch lip 16 on main case 10. When case cover 30 is maintained in a closed position, mirror 42 presses against cover bumper 72*a,* thereby reinforcing the seal between container cover 70 and container 52.

In order to access the cosmetic material held within the cosmetic case, the user first releases main latch mechanism 5 and then rotates case cover 30 upward and rearward on case hinge 3 to expose the internal area of main case 10. Next, the user pulls upward on lift flange 80 to release the joint formed between lock fingers 74*a* and lock tabs 62 and rotate container cover 70 upward and to the right on hinge structure 64. The cosmetic material held within container 52 is fully exposed as container cover 70 opens to the outside of main case 10.

In this second embodiment, container cover 70 installs easily to refill container 50, thereby allowing container cover 70 to be detached when container 52 is filled with a cosmetic material. The absence of container cover 70 during the filling process prevents container frame 50*a* from inclining as a result of an upset center of gravity caused by an attached and opened container cover 70, thereby solving one problem formerly associated with filling a cosmetic container to which a cover is attached.

FIGS. 11 through 15 describe a third embodiment of the invention wherein the orientation of tray 38 within internal space 11 is reversed in regard to the first embodiment. In other words, in this third embodiment container 52 is located in the forward area within main case 10, and applicator storage space 14 is located in the rear area of main case 10. Cutout space 22 is formed within perimeter wall 10*a* on the left side of internal space 11.

As container 52 is provided at the front part of main case 10, mirror 42 is located farther from the cosmetic material when case cover 30 is fully open, thus reducing the chances of cosmetic material soiling the mirror when applying said material.

FIGS. 16 through 20 describe a fourth embodiment of the invention wherein compartment 12, as presented in the second embodiment, is integrally formed within the front area of main case 10, and compartment 13 is integrally formed within the rear area of said case. Cutout space 22 is formed at the left side of compartment 12 within perimeter wall 10*a*.

FIGS. 21 through 25 describe a fifth embodiment of the invention wherein perimeter wall 10*a* and floor 10*c* define the shape of main case 10 as an approximate square figure. In this embodiment only container 52 is installed within main case 10. Cutout space 22 is formed on the left side of case space 11 within perimeter wall 10*a,* and located so as to prevent container cover 70 and case cover 30 from overlapping when case cover 70 is open. In terms of practical design, cutout space 22 is formed in an area between main latch mechanism 5 and case hinge 3.

Figure 26:
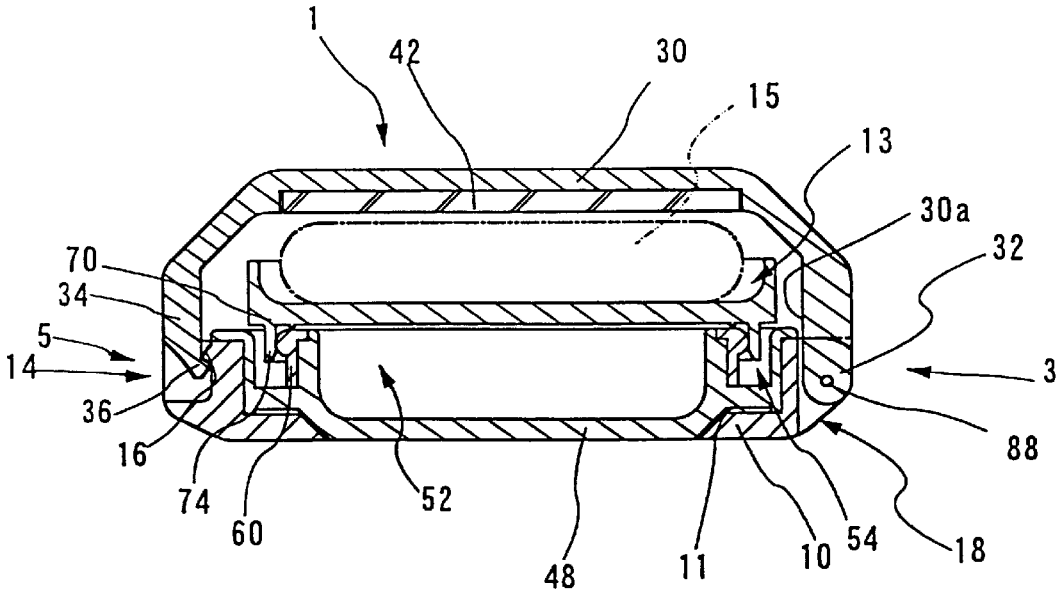
FIG. 26 is a lateral cross sectional view of first modified version of the fifth embodiment.
Figure 27:
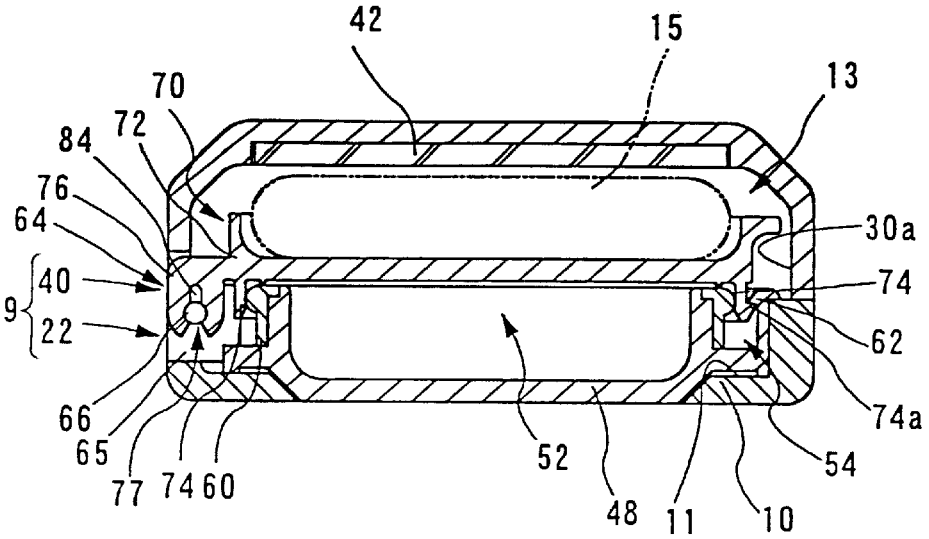
FIG. 27 is a front cross sectional view of the first modified version of the fifth embodiment shown in FIG. 26.
Figure 28:
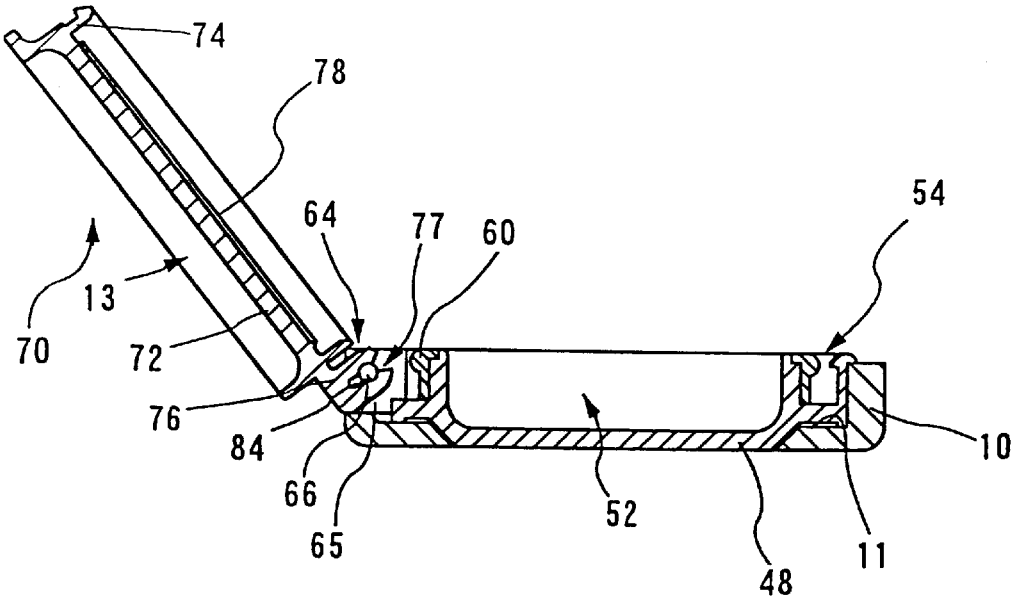
FIG. 28 is a lateral cross sectional view of the first modified version of the fifth embodiment shown in FIG. 26.

FIGS. 26 through 30 describe a fifth embodiment of the invention wherein (as shown in FIGS. 26 through 28) container tray 13 is integrally formed to the upper side of container cover 70, and perimeter wall 30*a* of main cover 30 is formed to a greater height as means of creating space above container cover 70 for the inclusion of cosmetic applicator tool 15.

This structure provides for an overlapping vertical placement of container 52 and container tray 13, thus allowing container 52 and main case 10 to be of the approximate same size while still providing storage space for a cosmetic applicator tool, and thus allowing the cosmetic case to be made to smaller external dimensions.

Figure 29:
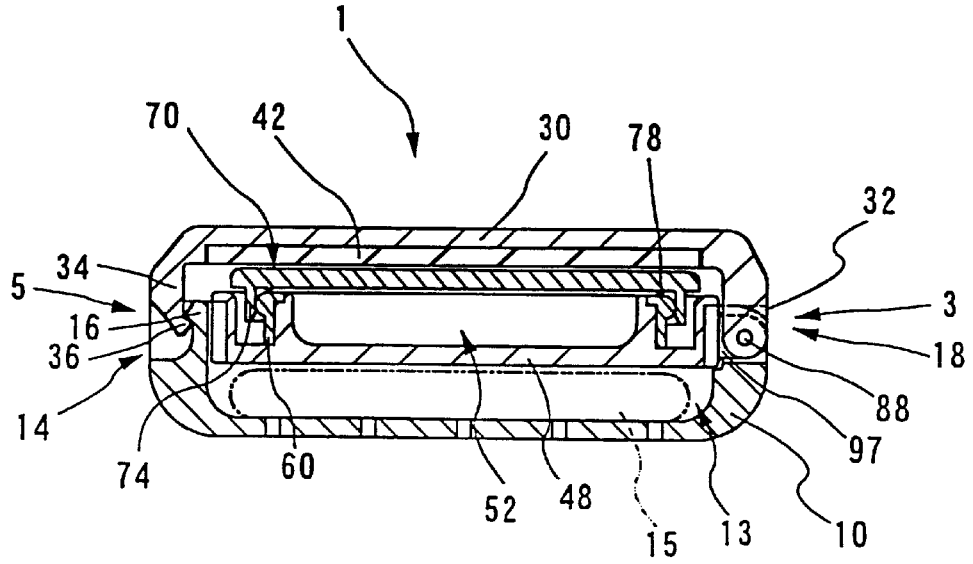
FIG. 29 is a lateral cross sectional view of a second modified version of the fifth embodiment.
Figure 30:
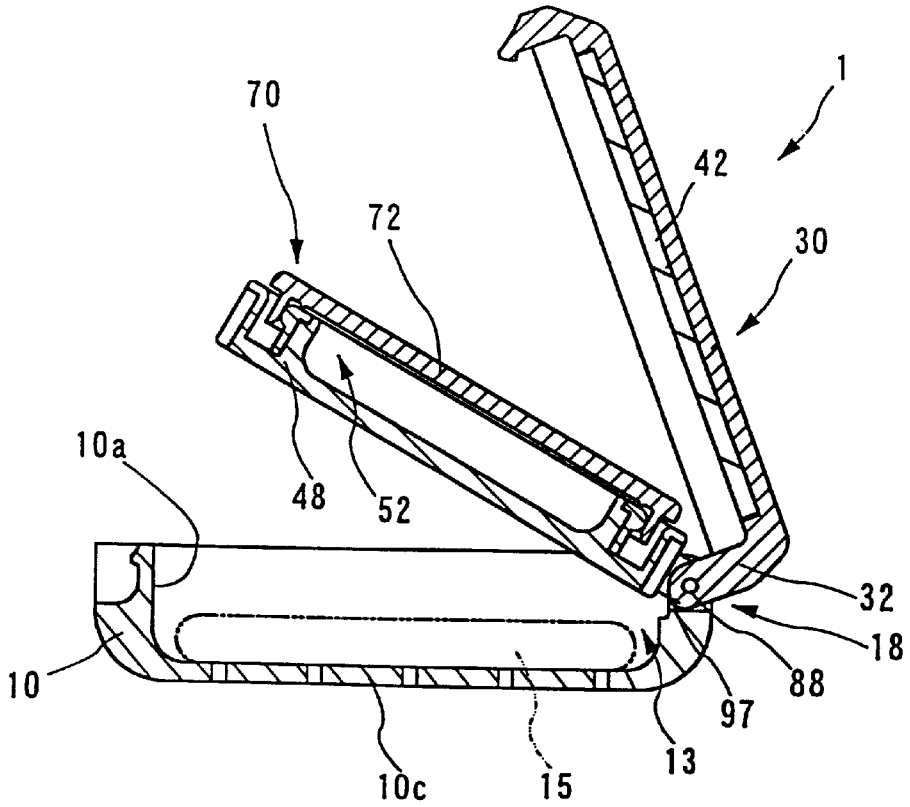
FIG. 30 is lateral cross section of the second modified version of the fifth embodiment with the case cover and tray in an open position.
Figure 31:
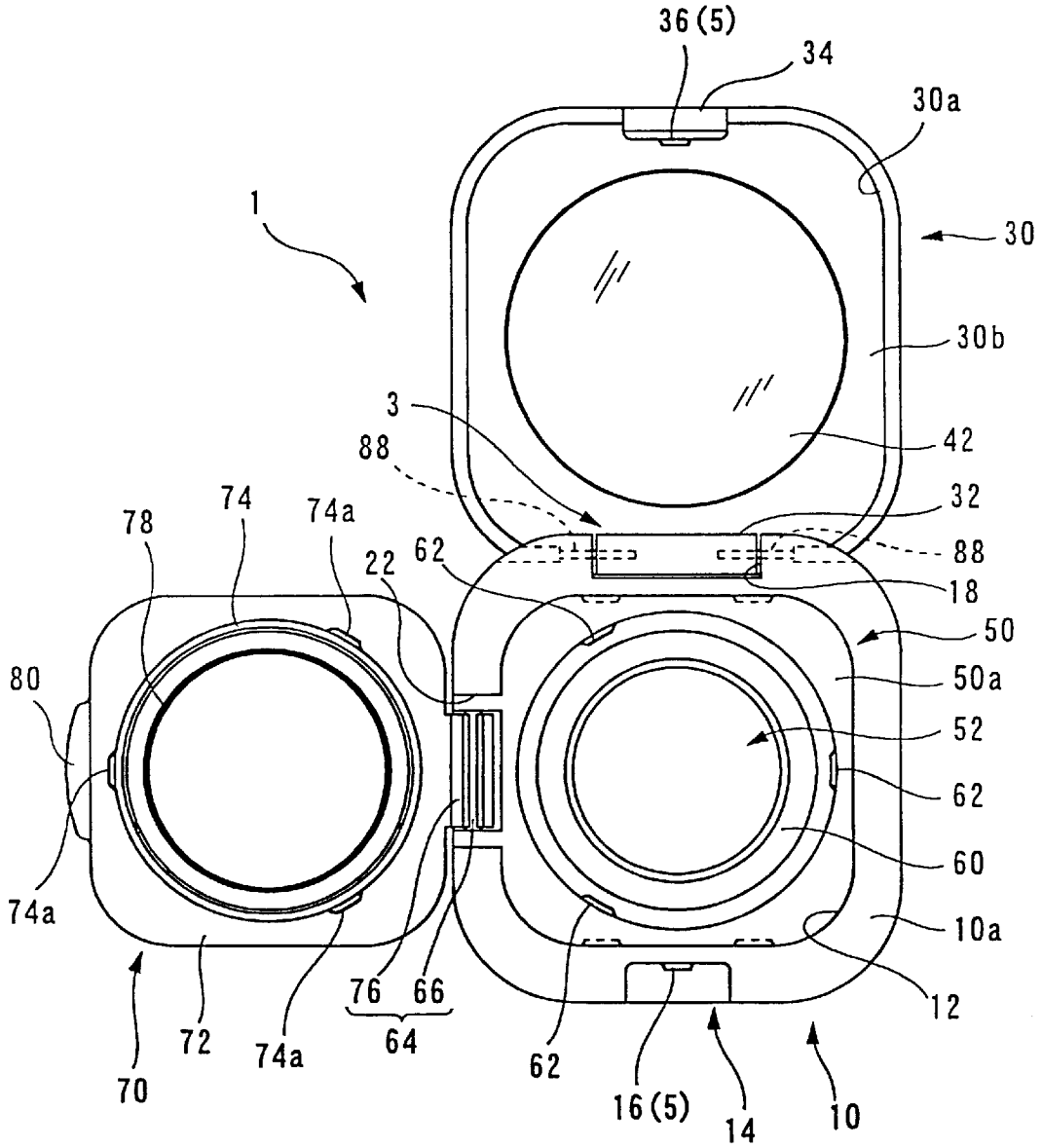
FIG. 31 is a plan view of the sixth embodiment of the invention.
Figure 32:
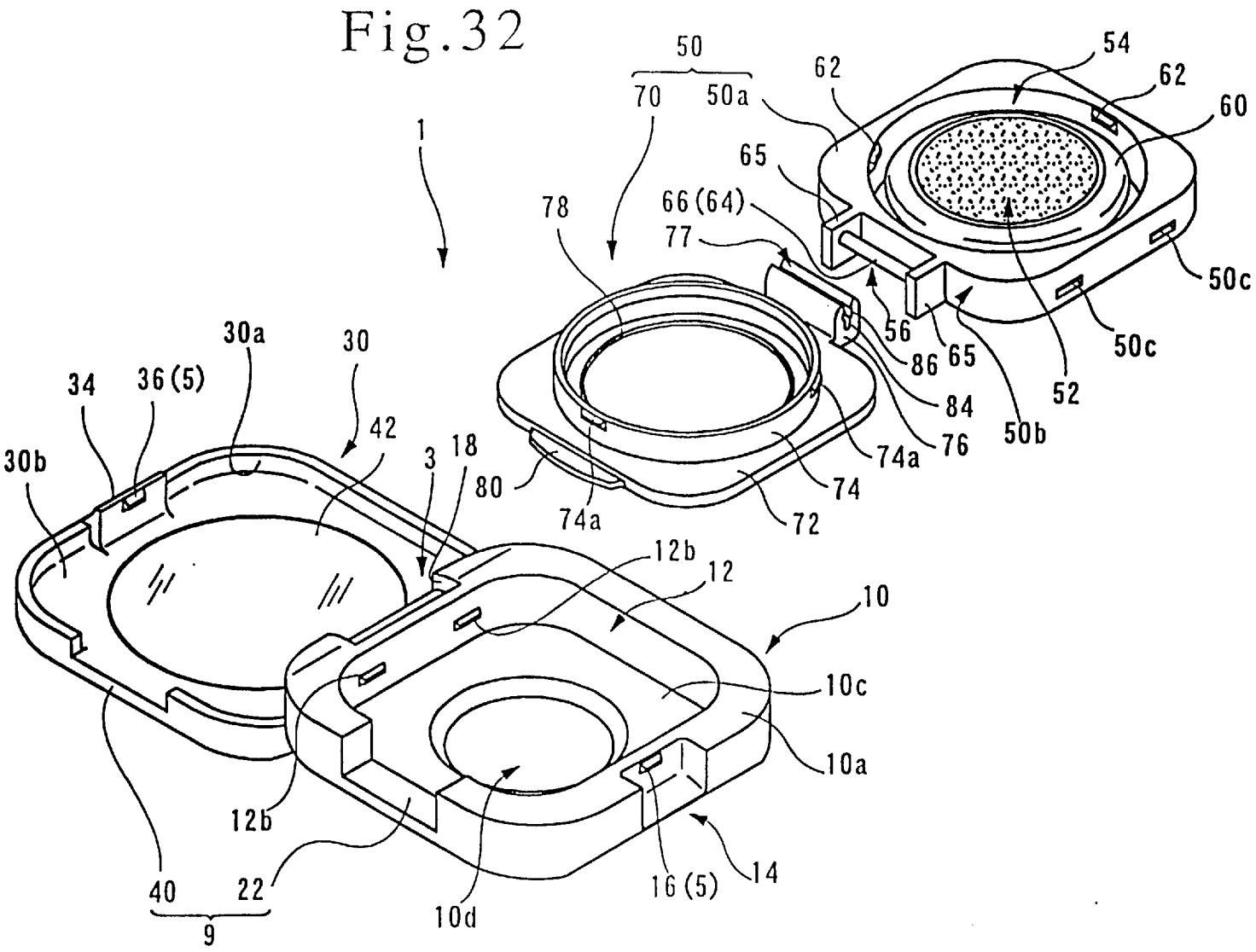
FIG. 32 is an oblique exploded view of the main structures of the sixth embodiment.
Figure 33:
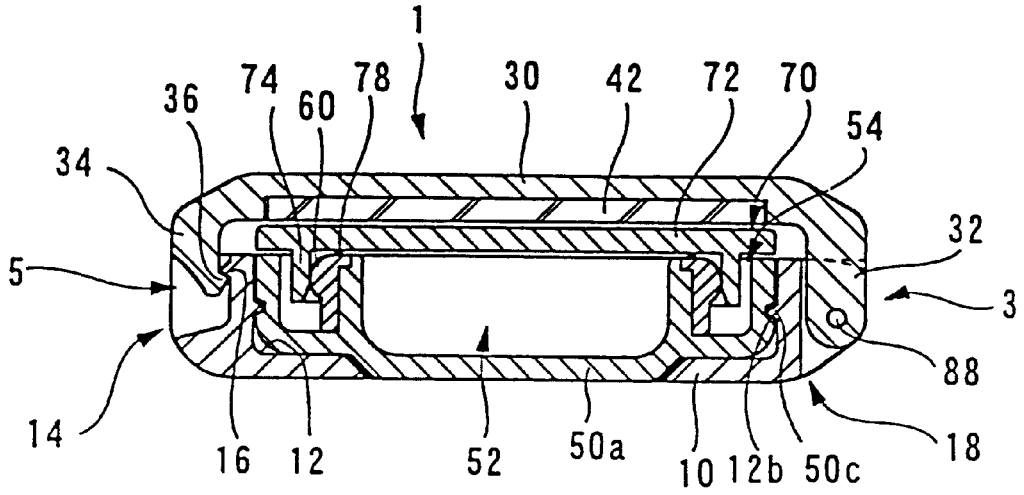
FIG. 33 is a lateral cross sectional view of the sixth embodiment.
Figure 34:
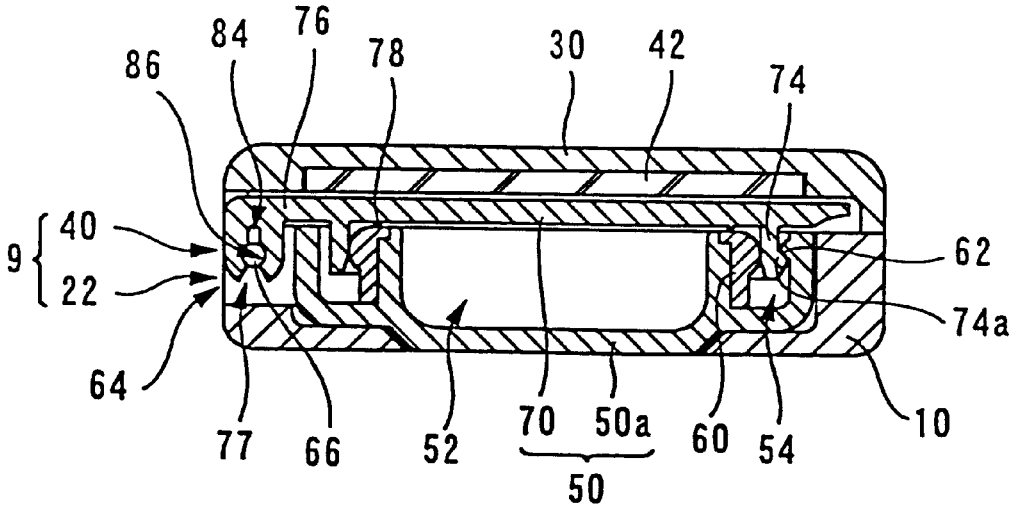
FIG. 34 is a front cross sectional view of the sixth embodiment.
Figure 35:
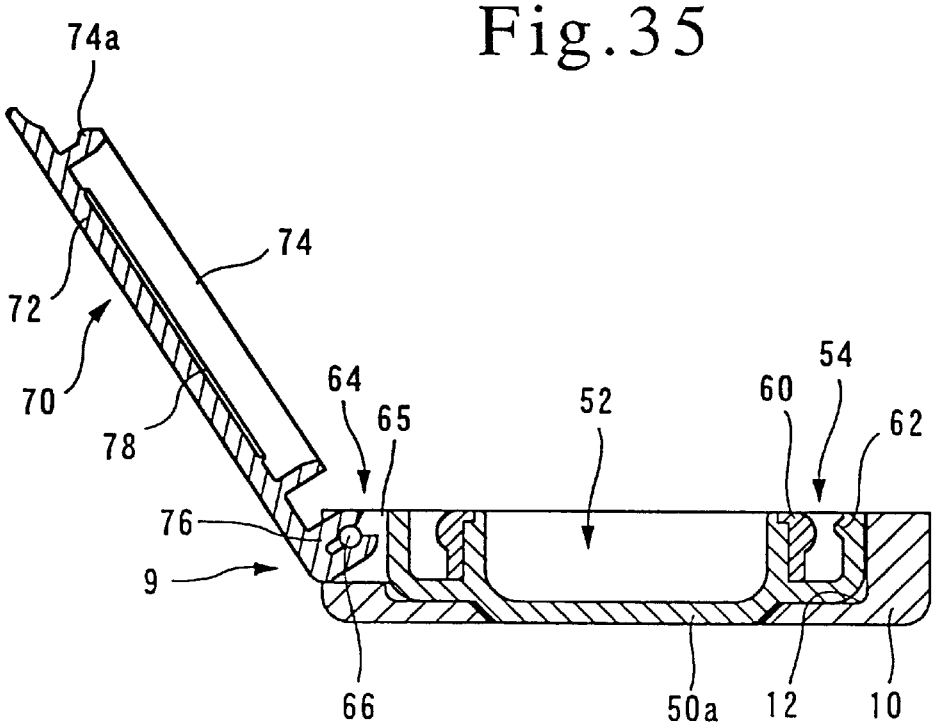
FIG. 35 is a front cross sectional view of the sixth embodiment with the container cover in an open position.
Figure 36:
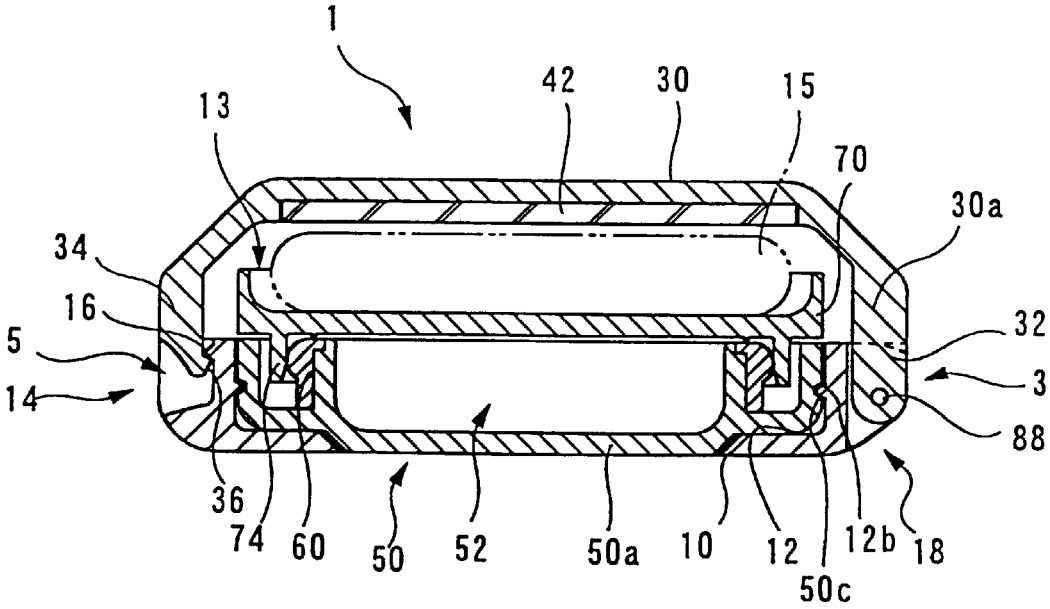
FIG. 36 is a side cross sectional view of a first modified version of the sixth embodiment.
Figure 37:
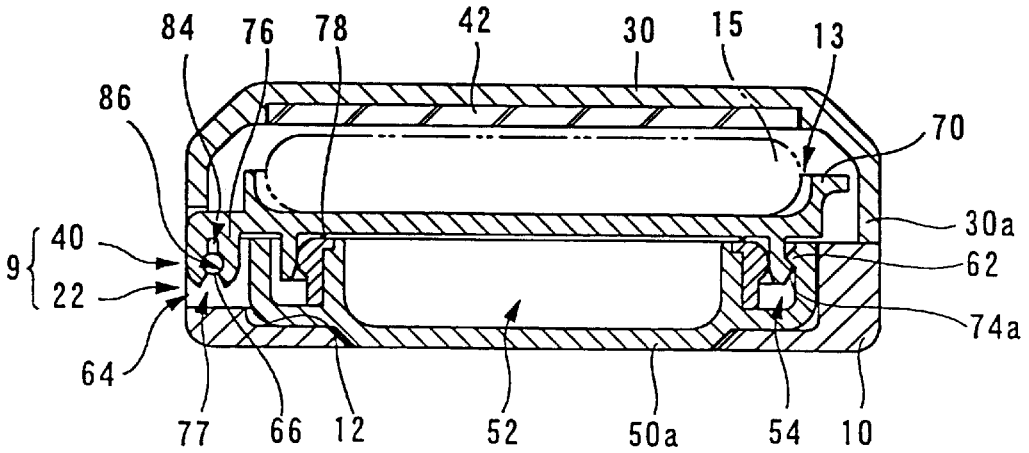
FIG. 37 is a front cross sectional view of the first modified version of the sixth embodiment.
Figure 38:
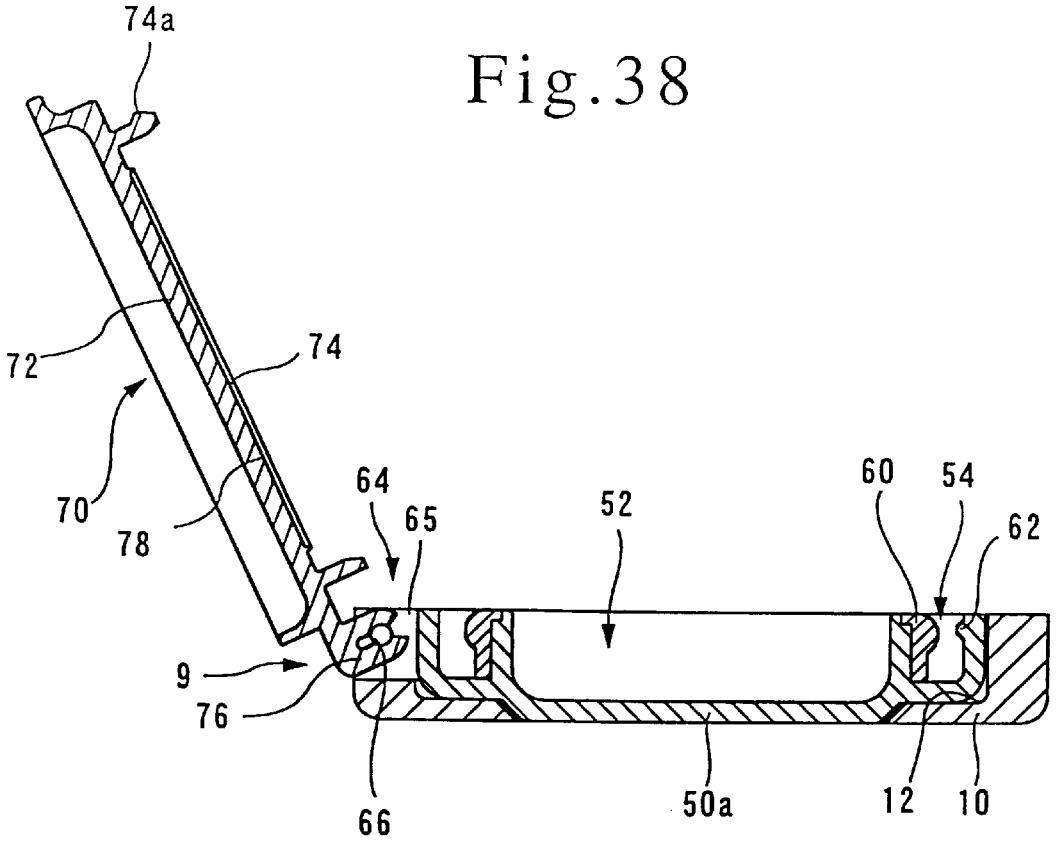
FIG. 38 is a front cross sectional view of the first modified version of the sixth embodiment with the container cover in an open position.

FIGS. 29 and 30 show a structure wherein container tray 13 is located beneath container 52. In this version, cutout space 22 is formed in tray 48, and tray 48 is pivotably attached to main case 10 through hinge 3, together with main cover 30, at a location above tray 13.

To explain in more detail, perimeter wall 10*a* of main case 10 is formed to a higher dimension, thus providing space for the storage of cosmetic applicator 15 beneath tray 48. Multiple ventilation orifices are formed within floor 10*c*. Hinge support 97 is formed on the rear extremity of tray 48 and inserts, along with hinge boss 32 of case cover 30, into hinge space 18 provided in main case 10. Hinge pin 88 is inserted within and through hinge boss 32 and hinge support 97 to form a hinged joint through which case cover 30 and tray 48 are able to rotate. This structure allows for the exposure of container case cover 70 when case cover 30 is rotated open, and provides further access to cosmetic applicator tool 15 within container tray 13 when tray 48 is pivoted open.

FIGS. 31 through 40 describe a sixth embodiment of the invention wherein refill container 50 is shown in place of tray 48 and container cover 70 illustrated in the fifth embodiment.

FIGS. 31 through 35 describe a version of the sixth embodiment in which only compartment 12 is provided within main case 10.

Figure 39:
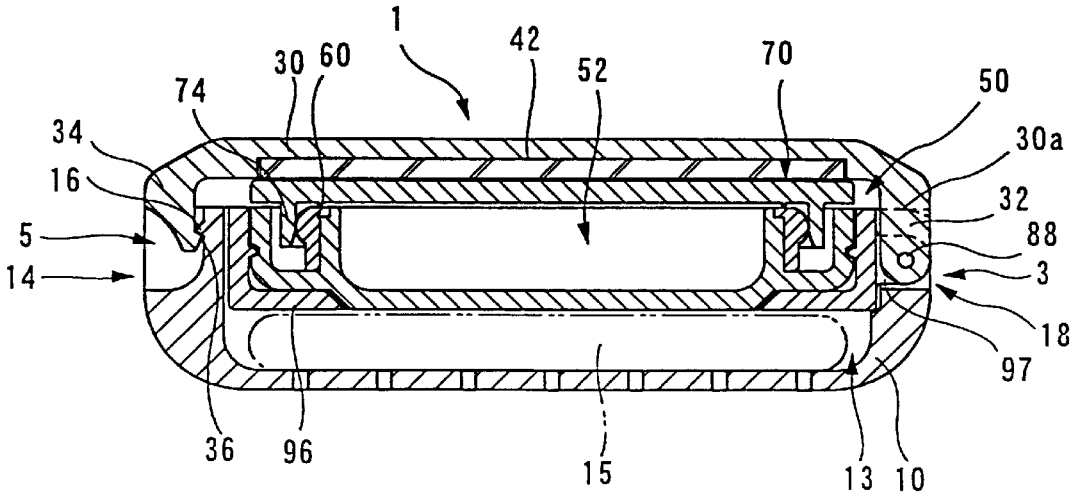
FIG. 39 is a lateral cross sectional view of a second version of the sixth embodiment.
Figure 40:
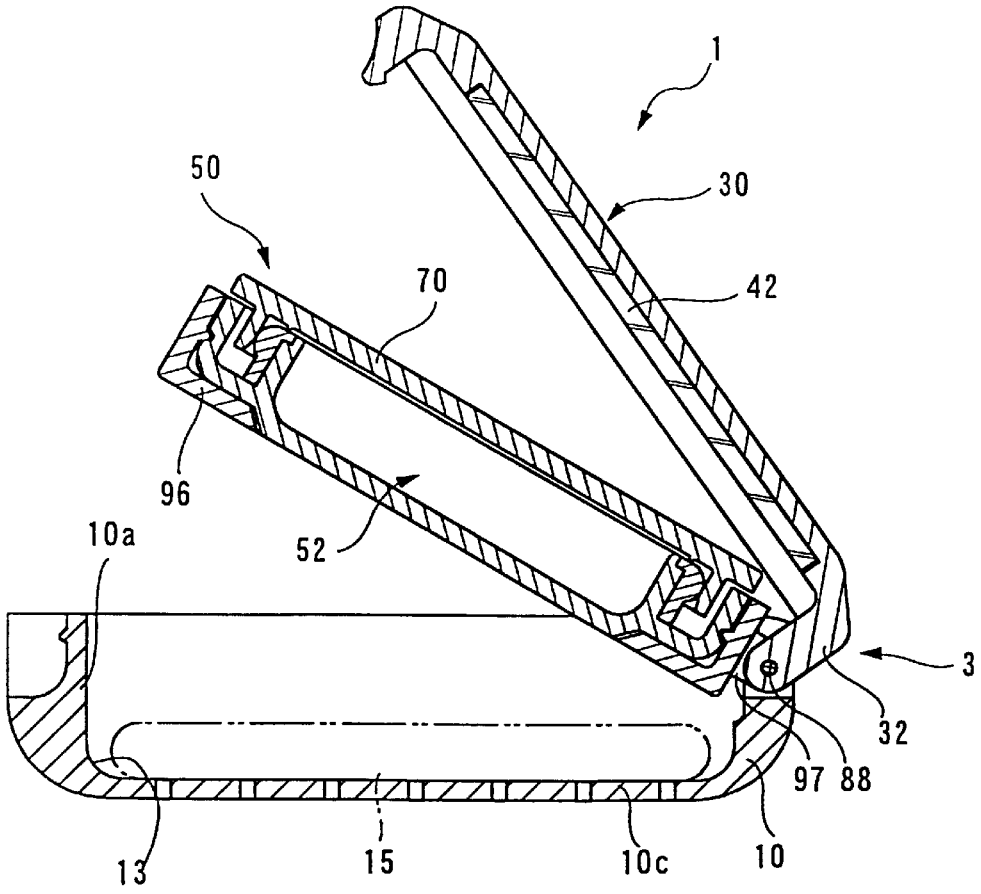
FIG. 40 is a lateral cross sectional view of the second version of the sixth embodiment with the case cover and mid-frame in an open position.
Figure 41:
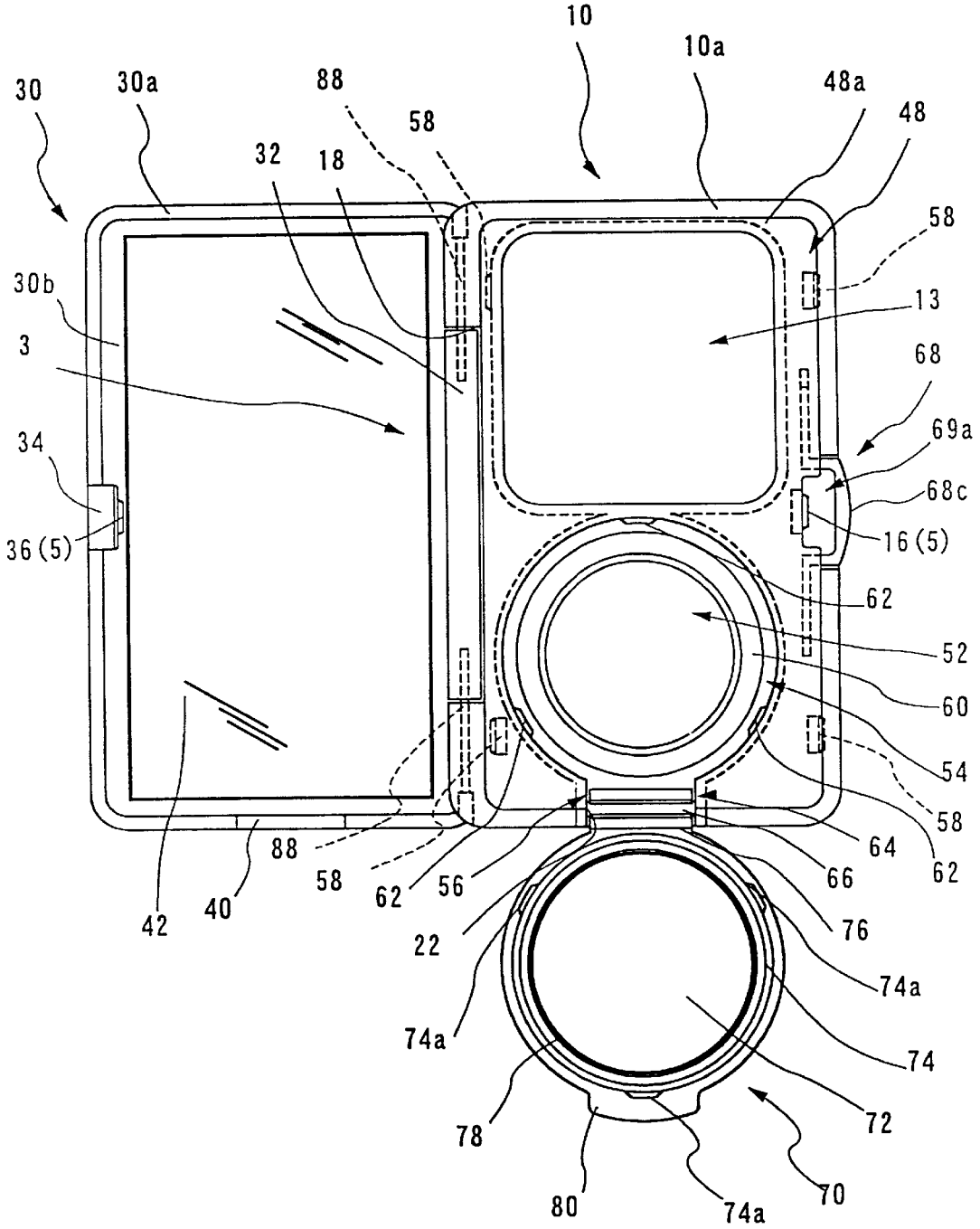
FIG. 41 is a plan view of the seventh embodiment of the invention with the case cover and container cover in an open position.
Figure 42:
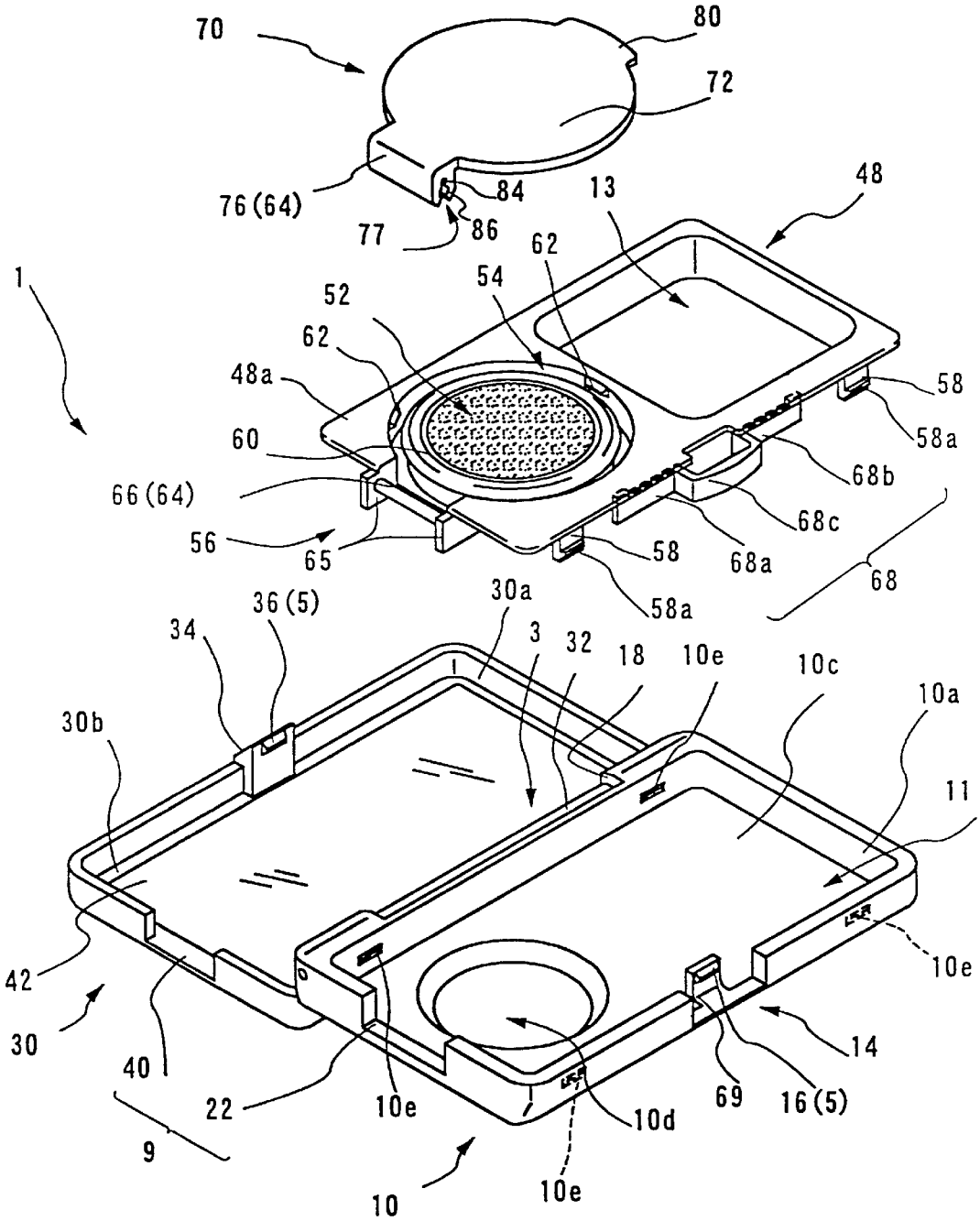
FIG. 42 is an oblique exploded view of the main structures of the seventh embodiment.
Figure 43:
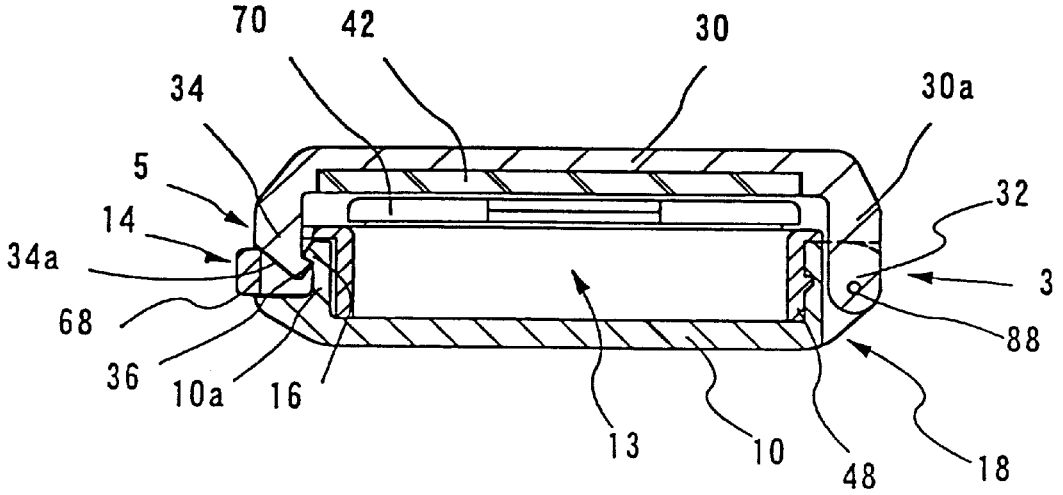
FIG. 43 is a lateral cross sectional view showing the position of the cosmetic applicator compartment.
Figure 44:
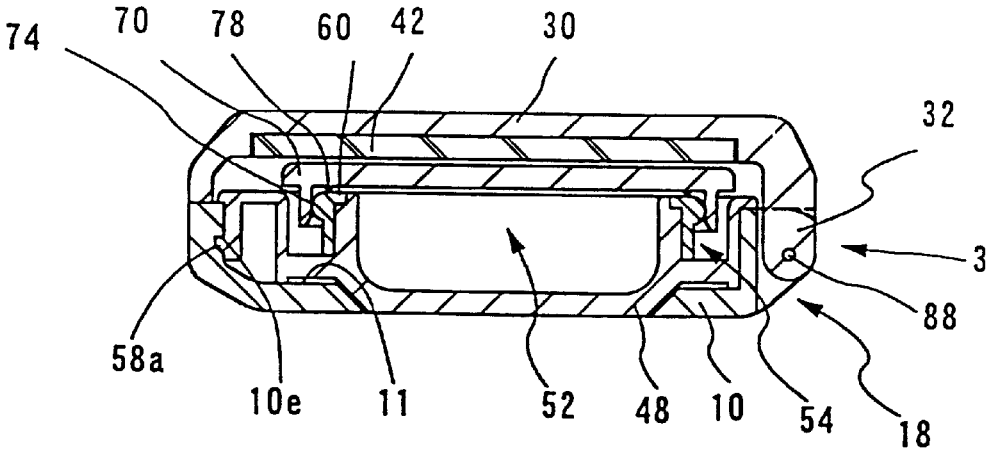
FIG. 44 is a lateral cross sectional view showing the position of the cosmetic applicator compartment.
Figure 45:
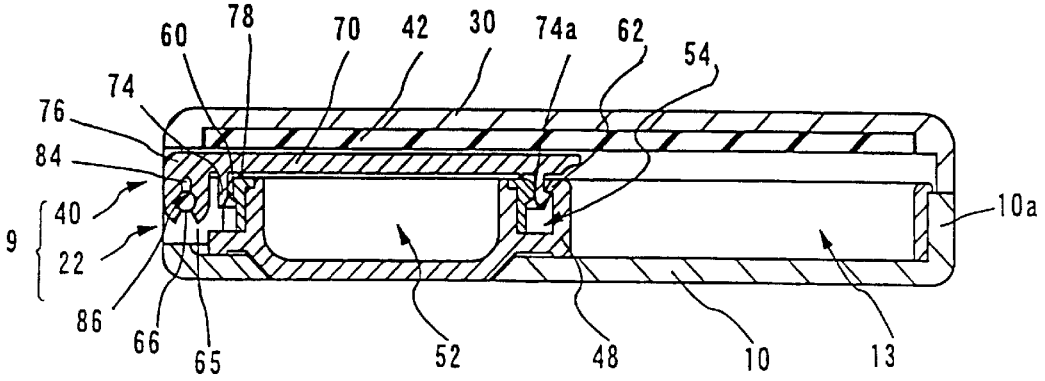
FIG. 45 is a front cross sectional view of the seventh embodiment.
Figure 46:
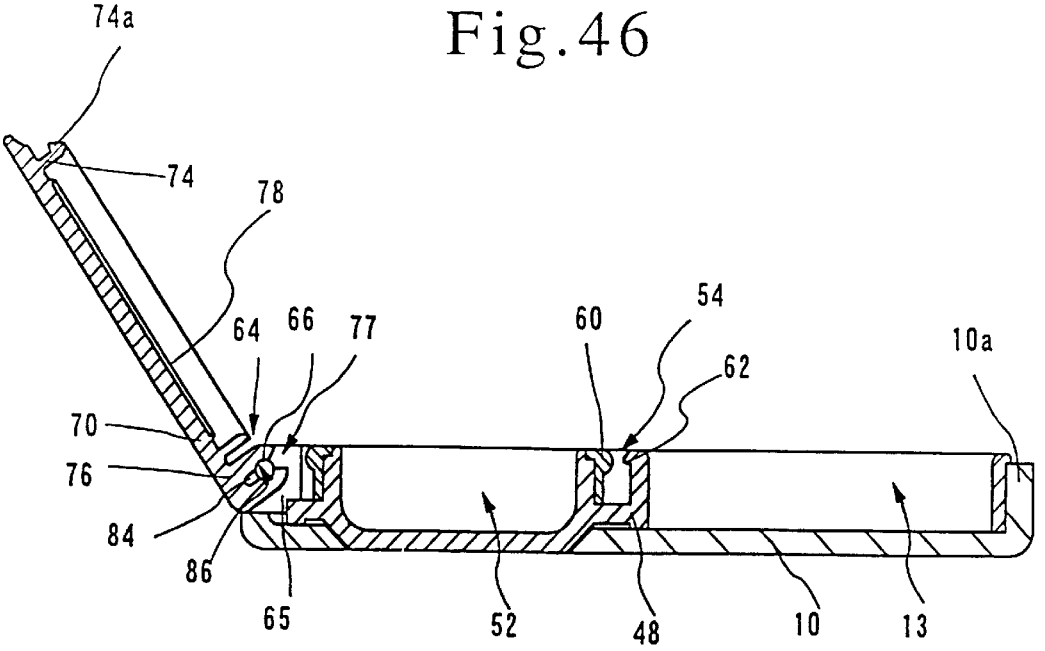
FIG. 46 is a front cross sectional view of the seventh embodiment with the container cover in an open position.
Figure 47:
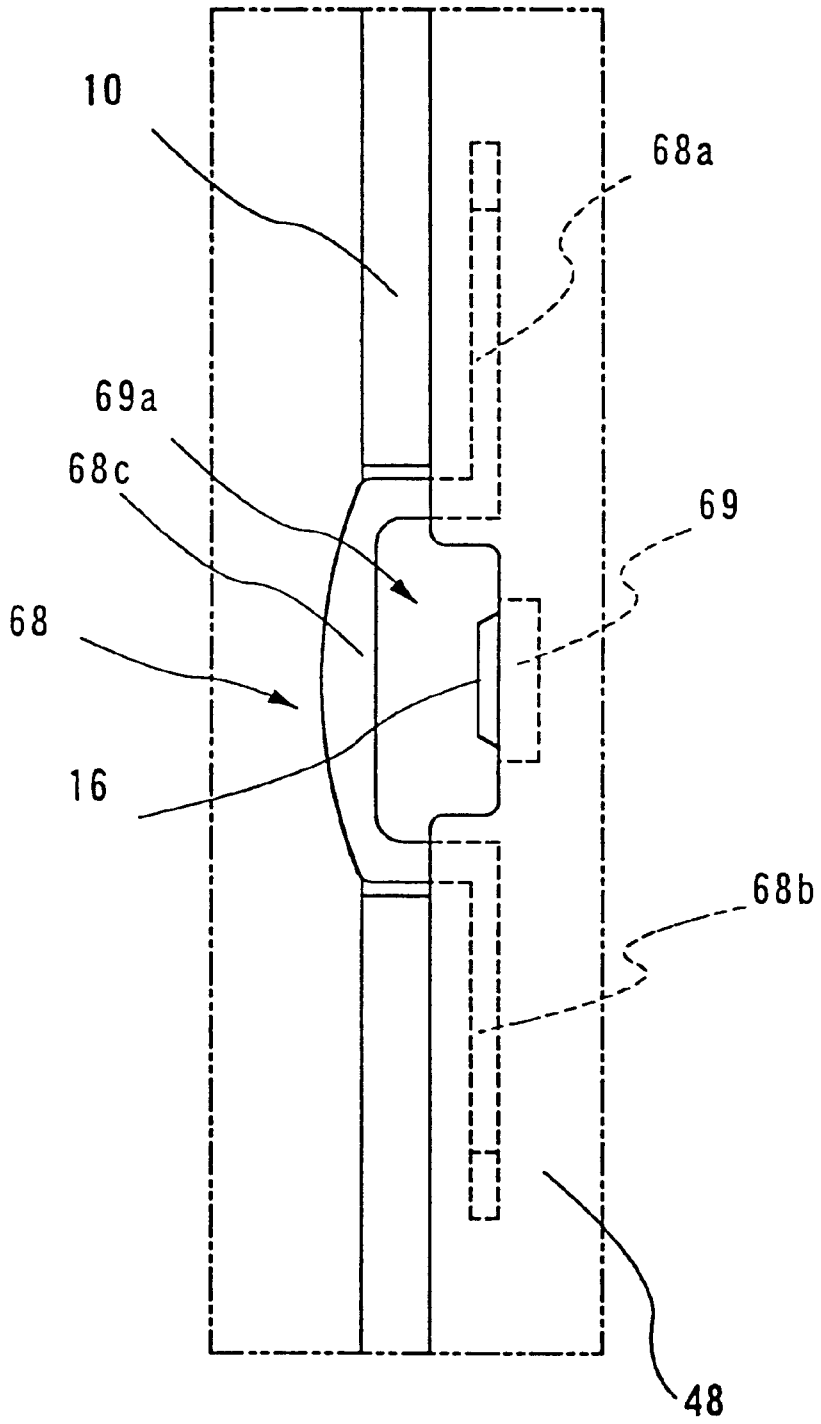
FIG. 47 is a plan view of the main cover release mechanism of the seventh embodiment.
Figure 48:
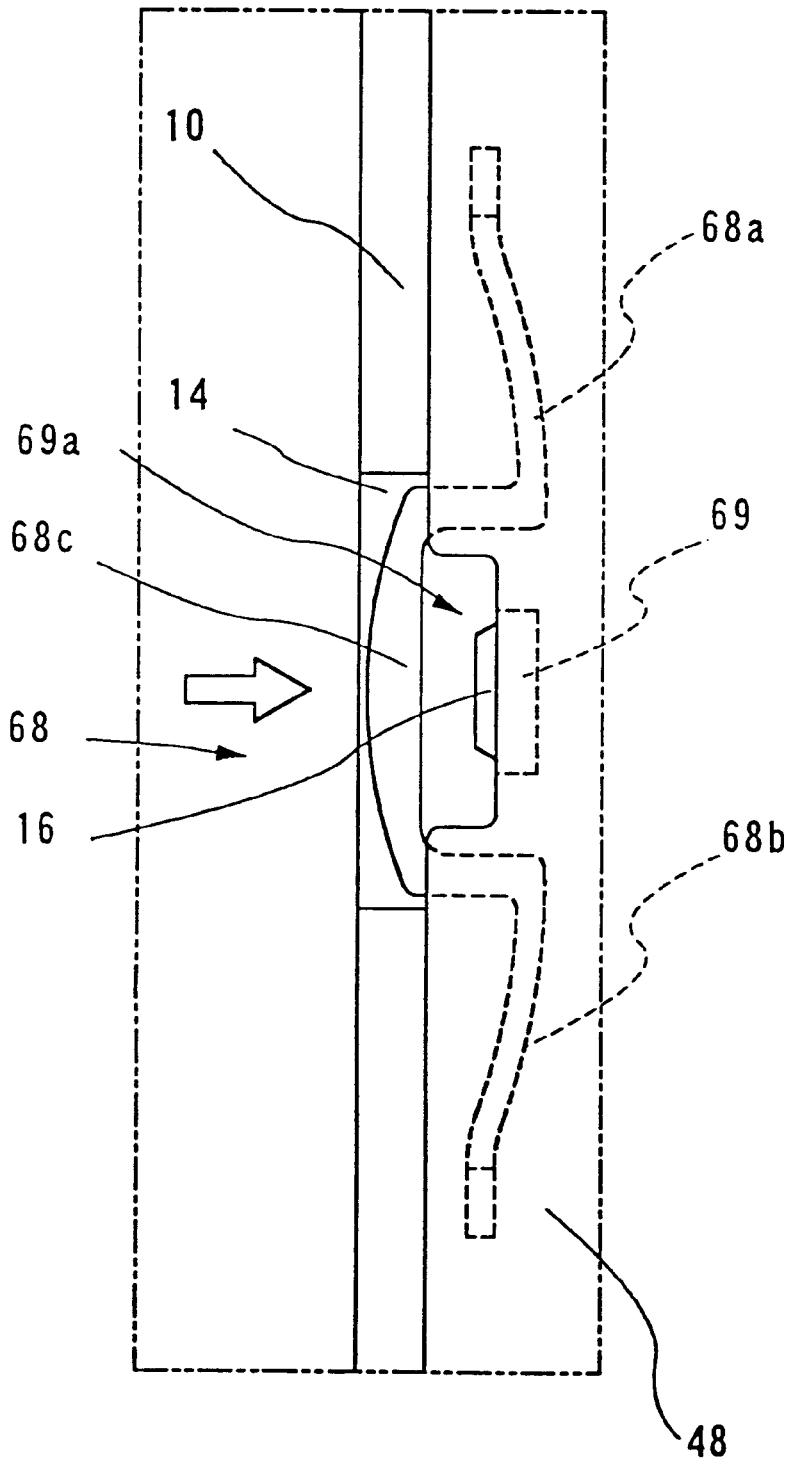
FIG. 48 is an enlarged plan view of the main cover release mechanism with said mechanism in an operating position.
Figure 49:
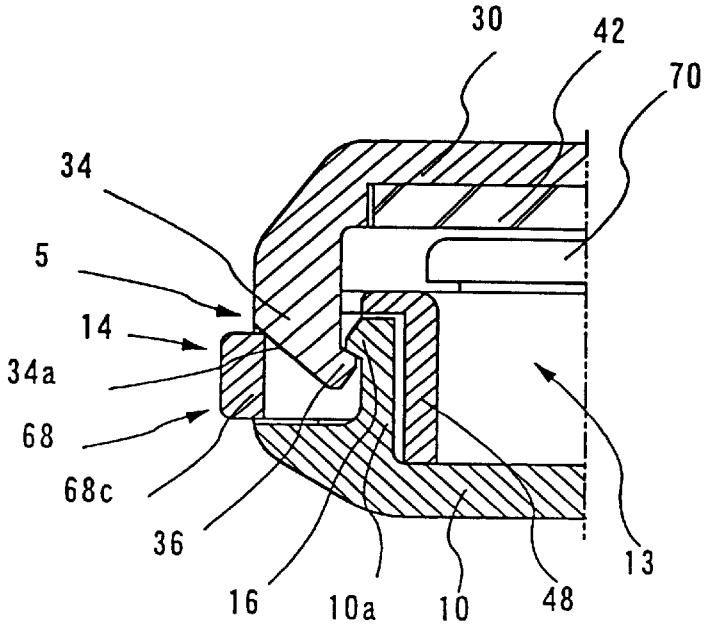
FIG. 49 is an enlarged lateral cross sectional view of the latch mechanism of the seventh embodiment with the latch mechanism in a locked condition.
Figure 50:
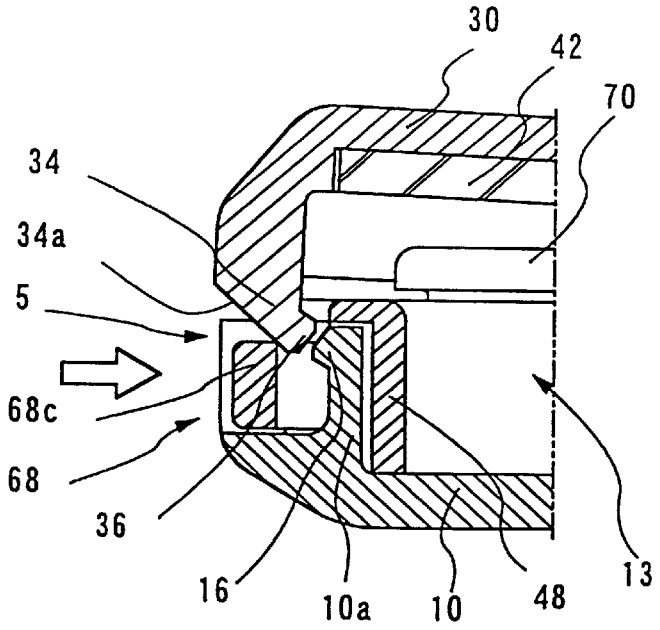
FIG. 50 is an enlarged lateral cross sectional view of the latch mechanism of the seventh embodiment with the latch mechanism in a released condition.
Figure 51:
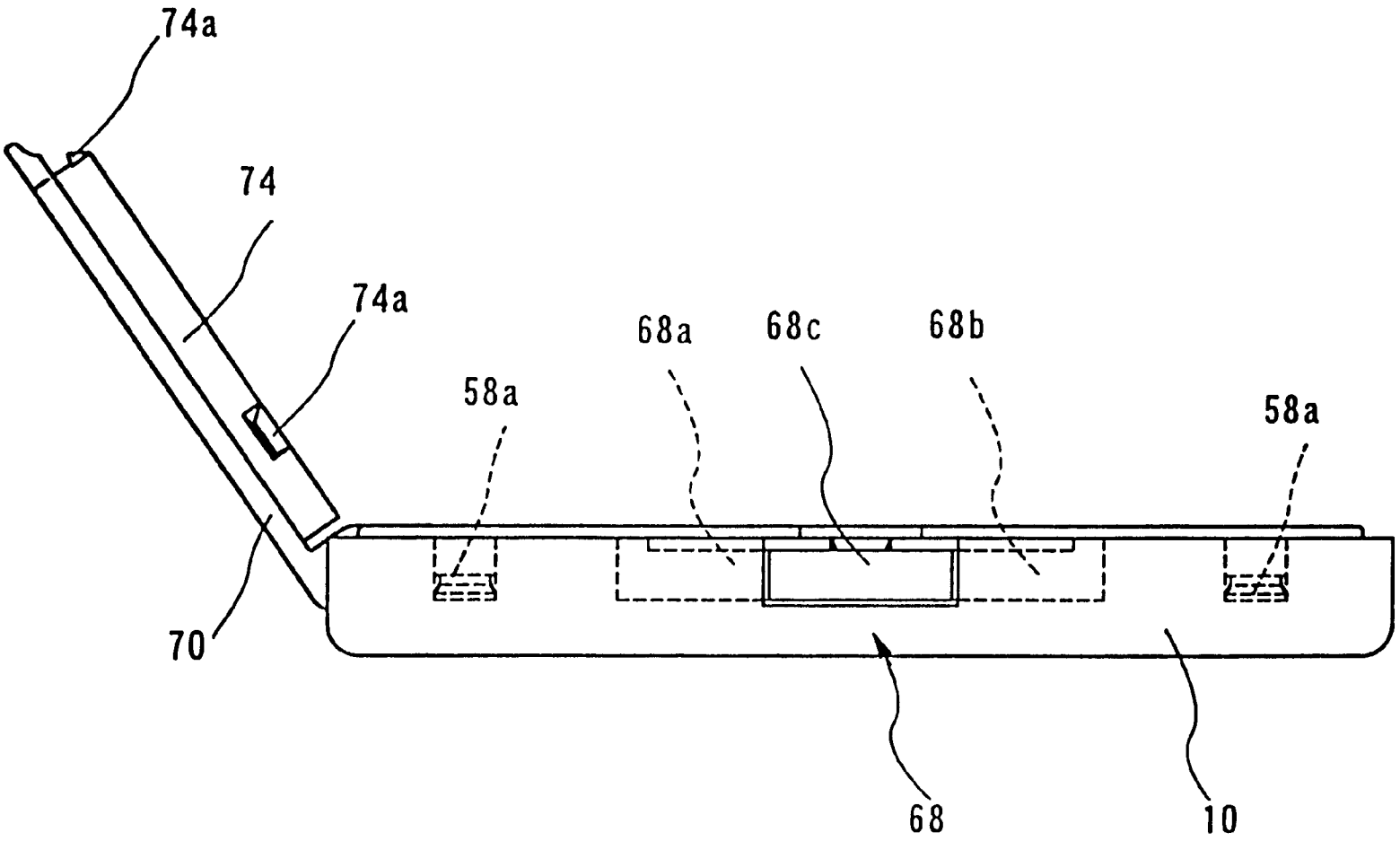
FIG. 51 is a front view of the seventh embodiment with the container cover in an open position.
Figure 52:
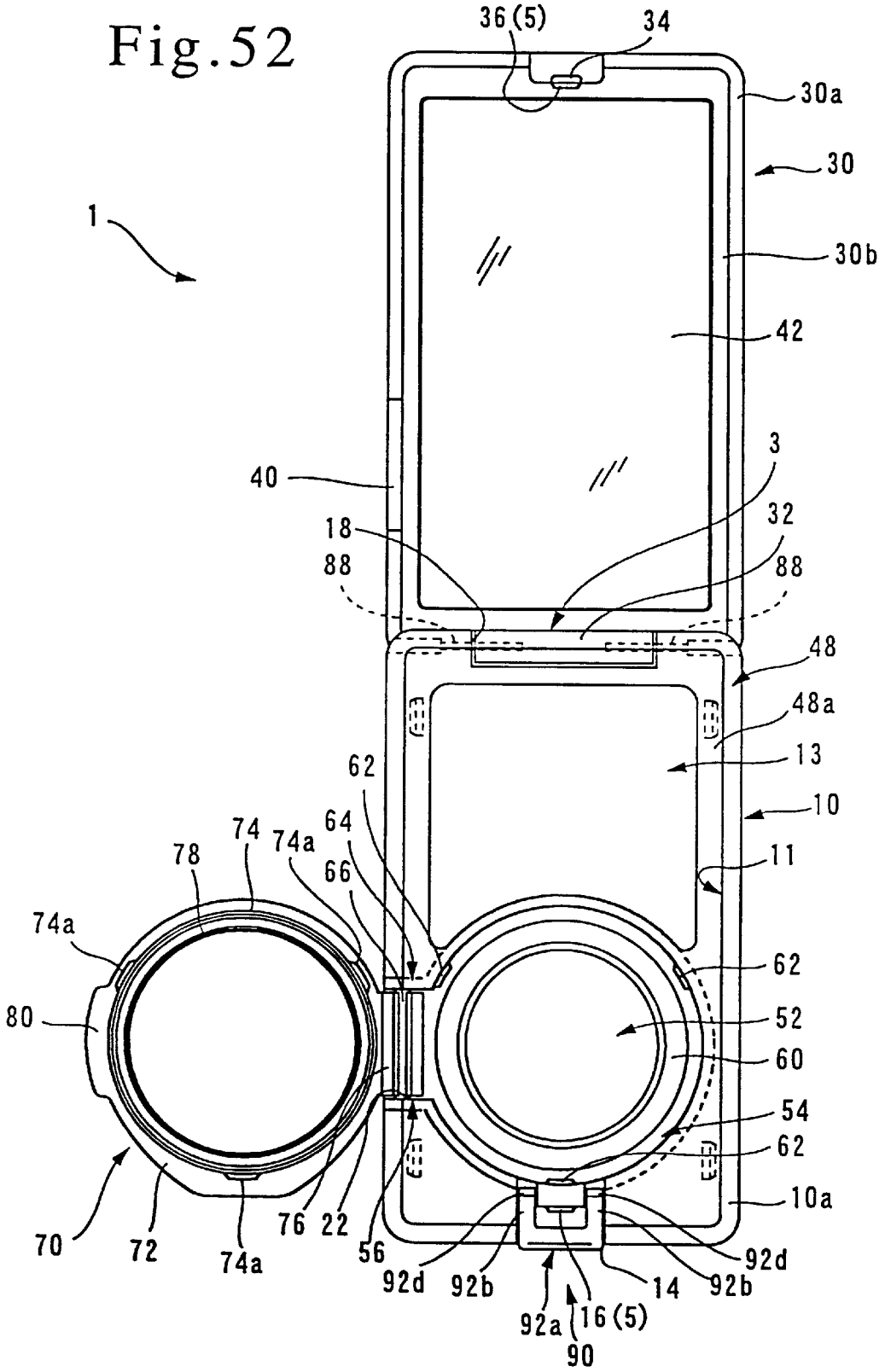
FIG. 52 is a plan view of the eighth embodiment of the invention with the case cover and container cover in an open position.
Figure 53:
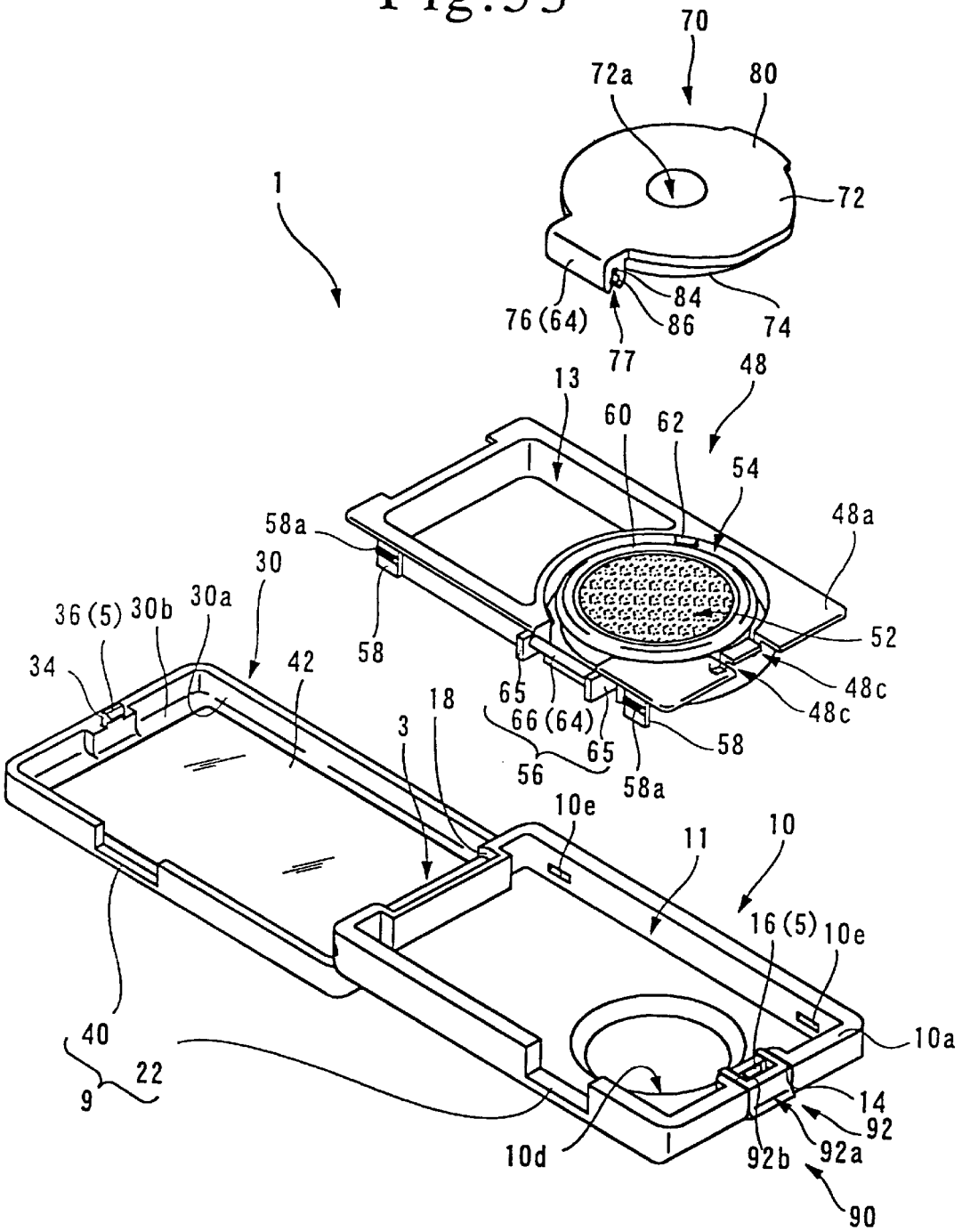
FIG. 53 is an oblique exploded view of the main structures of the eighth embodiment.
Figure 54:
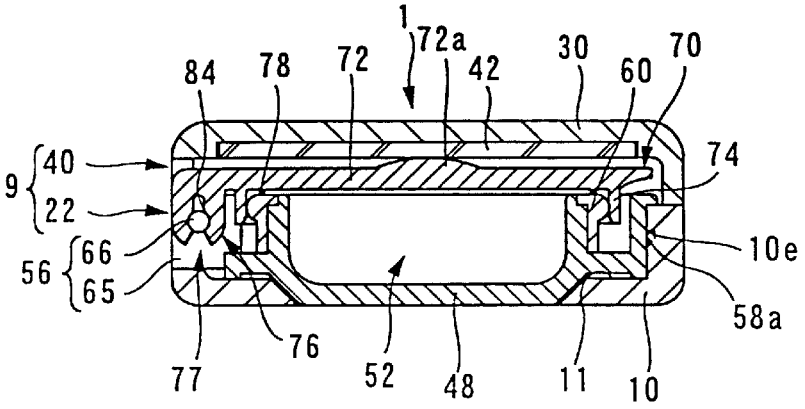
FIG. 54 is a front cross sectional view of the eighth embodiment.
Figure 55:
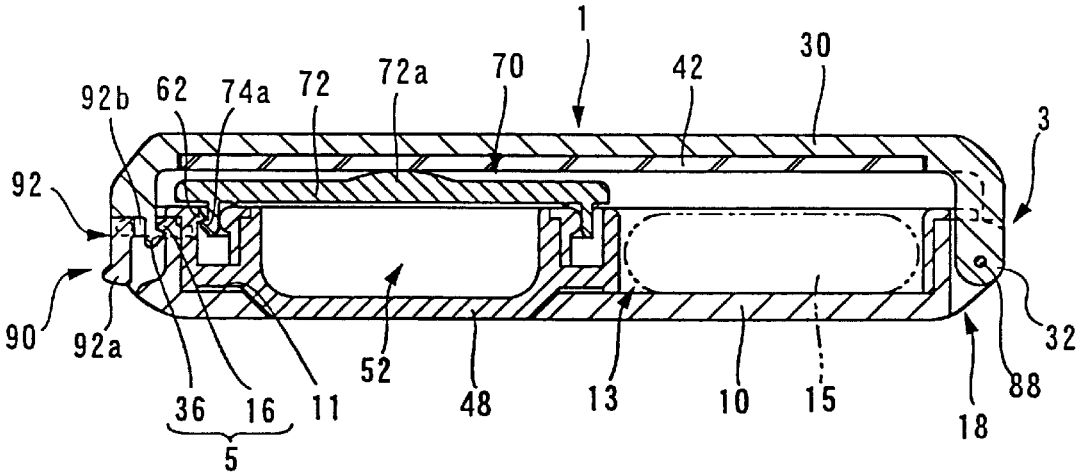
FIG. 55 is a lateral cross sectional view of the eighth embodiment.
Figure 56:
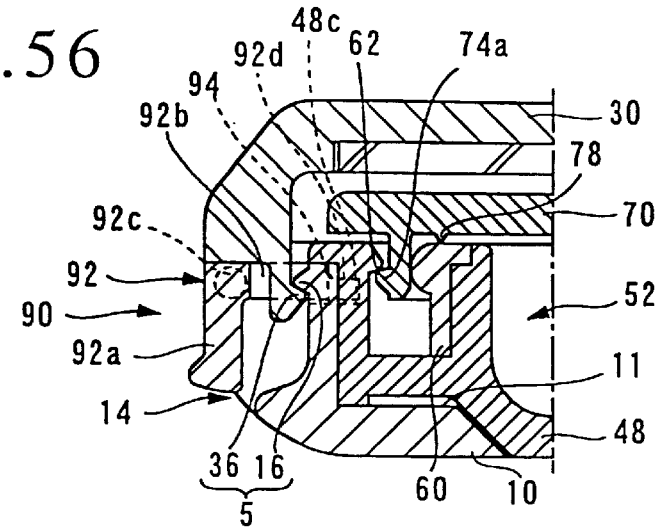
FIG. 56 is a detailed cross sectional view of the latch mechanism of the eighth embodiment with the case cover and container cover in a closed position.
Figure 57:
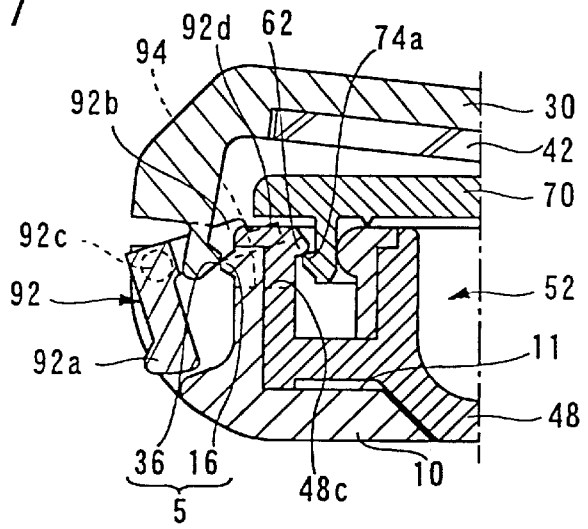
FIG. 57 is a detailed cross sectional view of the latch mechanism of the eighth embodiment with the case cover only in an open position.
Figure 58:
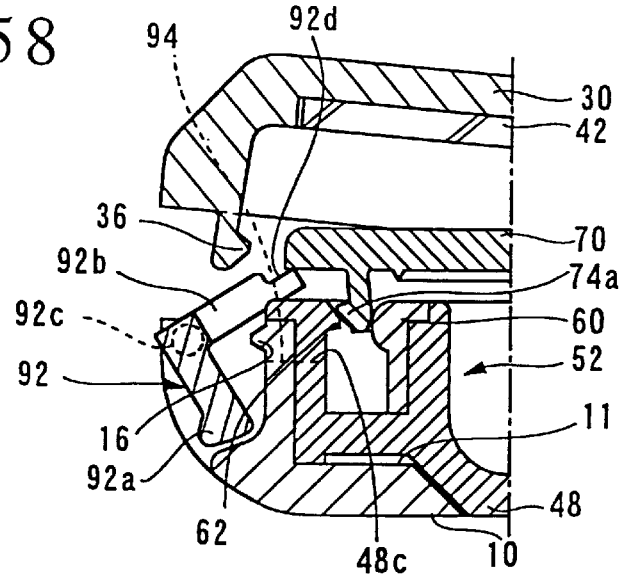
FIG. 58 is a detailed cross sectional view of the latch mechanism of the eighth embodiment with the case cover and container cover in an opened position.
Figure 59:
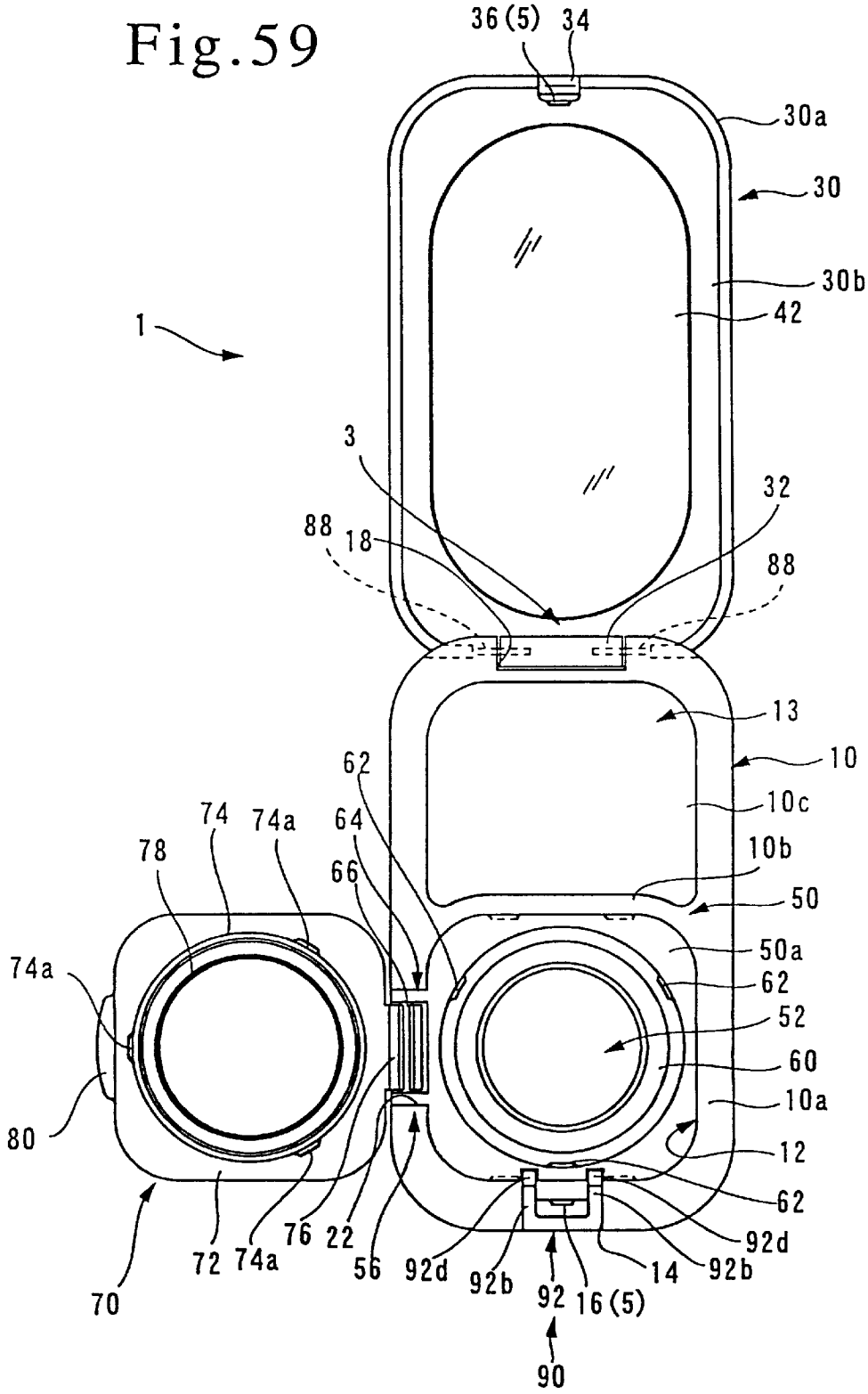
FIG. 59 is a plan view of a modified version of the eighth embodiment.
Figure 60:
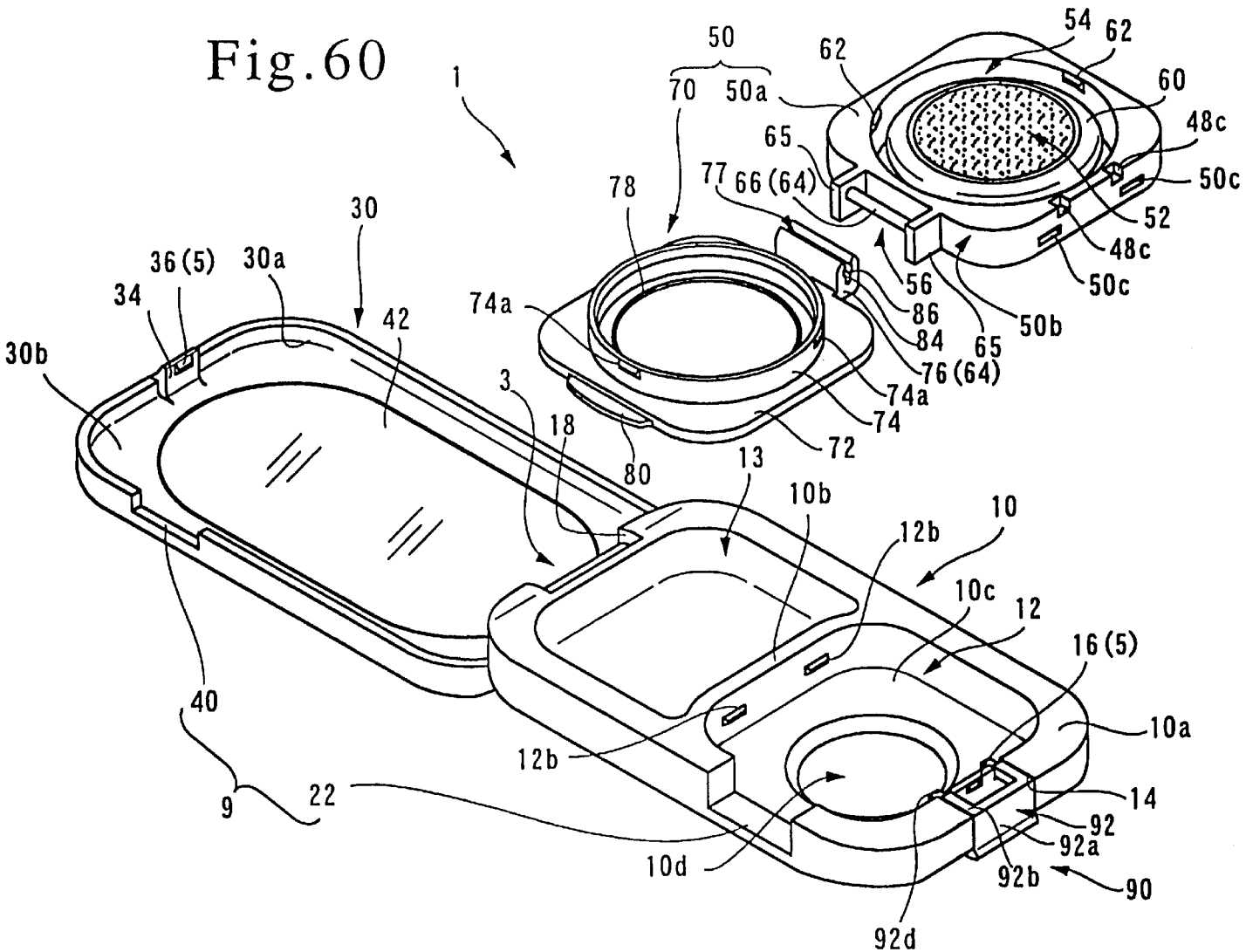
FIG. 60 is an oblique exploded view of the main structures of the eighth embodiment.
Figure 61:
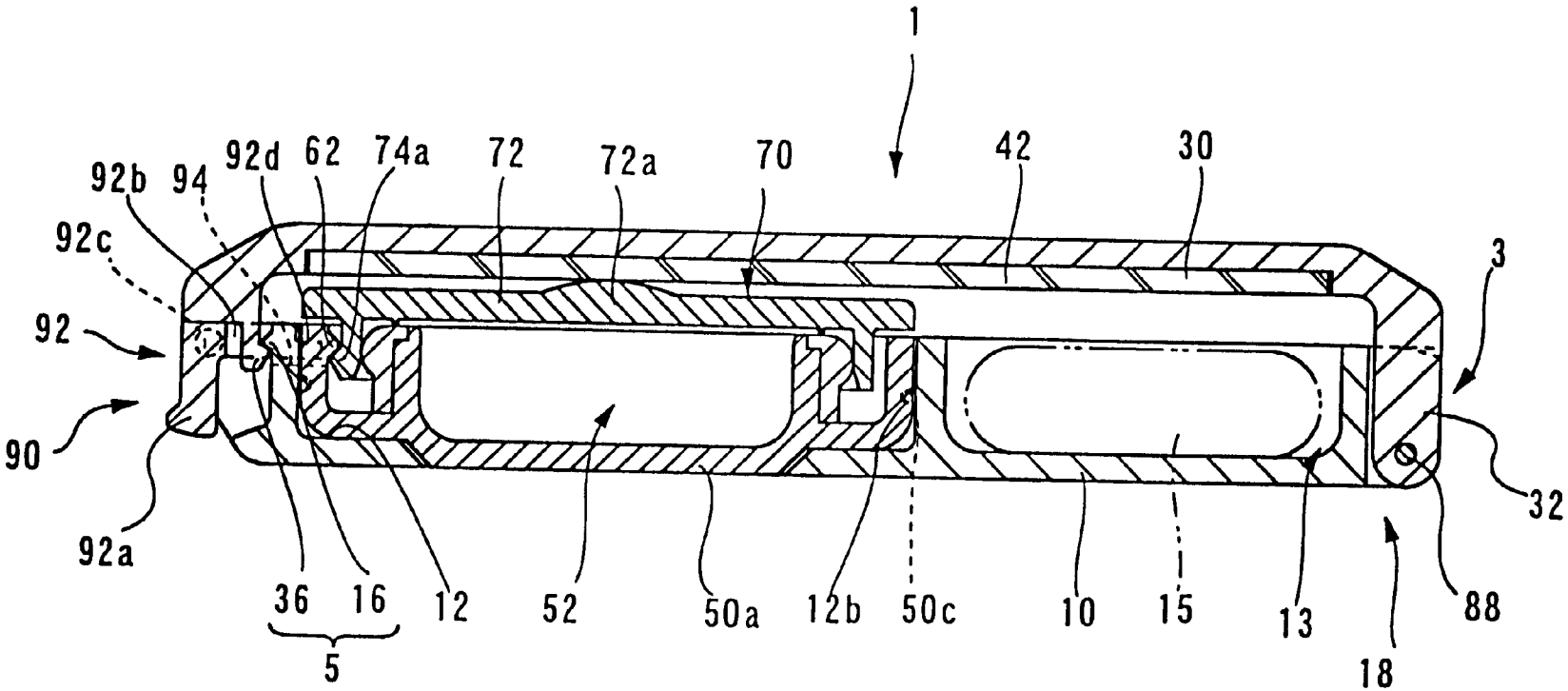
FIG. 61 is a lateral cross sectional view of the eighth embodiment.
Figure 62:
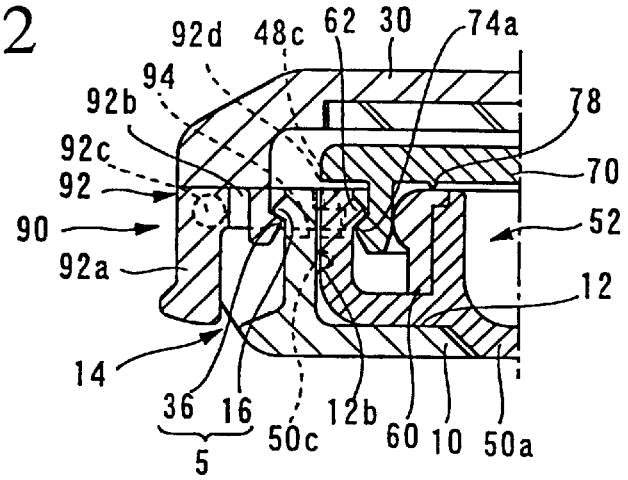
FIG. 62 is a detail cross sectional view of the release mechanism of the eighth embodiment with the case cover and container cover fin a closed position.
Figure 63:
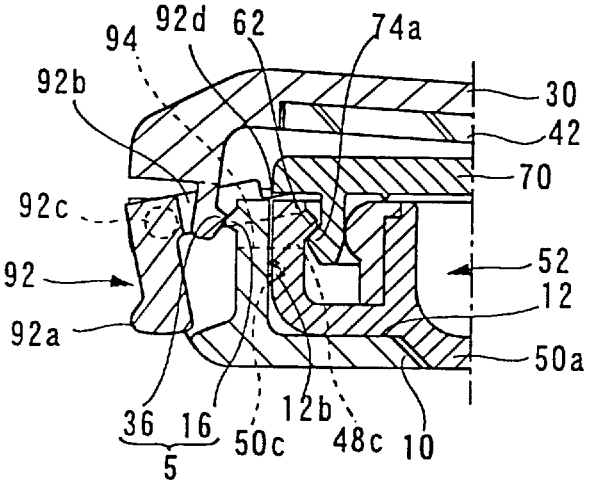
FIG. 63 is a detail cross sectional view of the release mechanism of the eighth embodiment with the case cover opened by the release mechanism and the container cover still closed.
Figure 64:
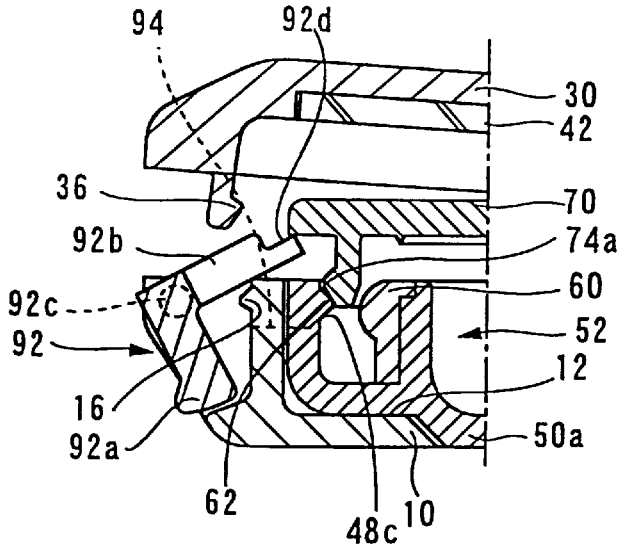
FIG. 64 is a detail cross sectional view of the release mechanism of the eighth embodiment with the case cover and container cover opened by the release mechanism.

FIGS. 36 through 40 describe versions of the sixth embodiment in which compartment 13 is provided either above or below compartment 12. FIGS. 39 and 40 show a modified version in which compartment 12 is formed by means of mid-frame 96 located within main case 10. Mid-frame 96 and main cover 30 are both pivotably installed to main case 10, and compartment 13 is located beneath mid-frame 96. As a result of this structure, case cover 30 opens to expose refill container 50, and mid-frame 96 opens to expose compartment 13 and cosmetic applicator tool 15.

FIGS. 41 through 51 describe a seventh embodiment of the invention wherein push-piece 68 is provided as a mechanism to release latch 5, push-piece 68 being integrally installed to tray 48 of the first embodiment. In this seventh embodiment, main case 10 is of rectangular shape with the longer sides being oriented in the horizontal direction. Internal space 11 is defined within main case 10 by means of perimeter wall 10*a* and floor 10*c*. Cutout space 22 is formed within the left side of perimeter wall 10*a* so as to form a continuous void connecting space 11 with the space external to the cosmetic case. Tray 48 is comprised of tray frame 48*a* which assumes the same contour as that of perimeter wall 10*a,* and container 52 and compartment 13 formed respectively within tray 48 in the left to right direction.

Latch cutout 14 is formed within perimeter wall 10*a* at the center of the front of case 10. Latch lip 16 is formed on the upper extremity of latch tab 69 which protrudes upward from within cutout 14. Latch tab 36, formed on the extremity of latch finger 34, is provided at the front extremity of case cover 30 as means of forming a releaseable joint by connecting to latch lip 16 in cutout space 14 when case cover 30 is closed, thus forming main latch mechanism 5. This latch mechanism is particularly characterized by inclined surface 34*a* formed on the front of latch finger 34.

Push-piece 68 is integrally formed to tray 48 and is comprised of left arm 68*a* connected to the left front center area of tray frame 48*a,* right arm 58*b* connected to the right front center area of tray frame 48*a,* and U-shaped push-part 68*c* located between and integrally connecting left arm 68*a* and right arm 68*b*. Push-part 68*c* is movable in the fore-aft direction by means of the flexible tensile support characteristic provided by left arm 68*a* and right arm 68*b*. Release part 48*d* is formed on tray frame 48*a* and located above push-part 68*c*. Latch cutout 69*a,* also formed on tray frame 48*a,* extends from release part 48*d* to an area above U-shaped push-part 68*c* as means of allowing latch finger 34 to insert behind push-piece 68.

When main cover 30 is held closed against main case 10 through main latch mechanism 5, push-part 68*c* is outwardly exposed within cutout 14. Forcibly pressing against push-piece 68 has the result of temporarily deforming left and right arms 68*a* and 68*b* in a rearward direction, thus bringing push-part 68*c* into contact with inclined surface 34*a* on latch finger 34 so as to forcibly push latch finger 34 upward, thus releasing the joint formed by main latch structure 5.

This seventh embodiment provides a structure in which push-piece 68 is integrally installed to tray 48, thereby reducing the number of components of which the cosmetic case consists and also eliminating the need for a separate assembly operation to install push-piece 68. The incorporation of inclined surface 34*a* on latch finger 34 allows push-part 68*c* to apply upward pressure on latch finger 34, thereby releasing the joint formed by main latch mechanism 5 and simultaneously pushing open case cover 30.

FIGS. 52 through 58 describe an eighth embodiment of the invention wherein the joint formed by main latch mechanism 5, and the joint formed between lock tabs 62 in circular sealing groove 54 and lock fingers 74*a* on container over 70, can both be released by means of release latch 90.

Release channel 94 is provided within cutout 14 of main case 10 at the upper extremity of perimeter wall 10*a,* and continues on both sides of latch lip 16 from cutout 14 into the area prescribed by circular sealing groove 54.

Cutout channel 48*c* is formed between release channel 94 and circular sealing groove 54 at the front of tray frame 48*a*.

Release latch 90 is a reverse inverted L-shaped part pivotably supported by pin 92*c* within cutout space 14, and incorporates ridge 92*a* formed on the exposed outward facing surface thereon. Flange 92*b* extends rearward from the forward facing surface of release latch 90 and resides within release channel 94 directly beneath case cover 30. Release lip 92*d* is formed on the rearward facing extremity of flange 92*b* and is located directly beneath container cover 70. Applying pressure to ridge 92*a* causes release piece 92 to rotate on pin 92*c,* thus resulting in flange 92*b* pushing upward against both case cover 30 and container cover 70, and thus releasing main latch mechanism 5 and the joint holding down container cover 70.

This embodiment makes it possible to open both case cover 30 and container cover 70 with a single operation of main release mechanism 5, thus making it more convenient to use the cosmetic case. Positional changes of pin 92*c* and modifications to the shape of flange 92*b* may provide for variations in the timing between the release of main latch mechanism 5 before container cover 70, thus allowing a partial movement of release piece 92 to open case cover 30 without opening container cover 70, and thus making it possible to view mirror 42 when access to the cosmetic material within container 52 is not desired.

FIGS. 59 through 64 describe a modification of the eighth embodiment wherein all of the structures of the eighth embodiment are employed with the exception of tray 48 being replaced by replaceable refill container 50.

What is claimed is:

1. A structure for a cosmetic case comprised of, a main case within which a wall part defines an internal space, a tray part installed within said internal space and incorporating at least a cosmetic material container part, a main case cover part pivotably attached to the rear extremity of said main case by means of a main hinge part, said main case cover part being capable of closing or exposing said internal space, a main latch mechanism releaseably connecting the front extremities of said main case and main case cover part, a container cover part pivotably installed as means of exposing or sealing said container part, a container hinge part detachably and pivotably connecting one extremity of said container cover part to an extremity of said tray part adjacent to the container part, a container latch mechanism installed between said container cover part and tray part as means of establishing a releaseable connection there between, and a cutout space formed within said wall part at a location within a region extending from said main hinge part to said main latch mechanism, said cutout space providing means of internally housing said container hinge part.

2. A cosmetic case structure as put forth in claim 1 wherein, said tray part is structured so as to incorporate only said cosmetic material container part, and said cutout space is provided as means of enclosing said container hinge part within said wall part surrounding said container part at a location within a region extending from said main hinge part to said main latch mechanism but not interfering with said main hinge and main latch mechanisms.

3. A cosmetic case structure as put forth in claim 1 wherein, said tray part is structured so as to incorporate a cosmetic applicator tool storage space located in front of a rearwardly disposed cosmetic material container part, and said cutout space is located within said wall part surrounding the rearwardly disposed container part, and positioned between said main hinge and main latch mechanism but not interfering with said main hinge and main latch mechanisms.

4. A cosmetic case structure as put forth in claim 1 wherein, said tray part is structured so as to incorporate a cosmetic applicator tool storage space located behind a forwardly disposed cosmetic material container part, and said cutout space is located within said wall part surrounding the forwardly disposed container part and located at a point lying in a region between said main hinge and main latch mechanism but not interfering with said main hinge and main latch mechanisms.

5. A cosmetic case structure as put forth in claim 1 wherein, a single release part is provided at the front extremity of said main case as means of releasing said main latch mechanism and container latch mechanism and thereby opening said main case cover part and container cover, said single release part being comprised of, a center section pivotably supported within said main case, an outwardly extending operating part exposed at the front of said main case, and a main case cover and container cover push-up part extending rearward from said center section in the opposite direction from said operating part, said push-part being pivotably installed through said center section so as to movably contact said main case cover and container cover.

6. A cosmetic case structure as put forth in claim 5 wherein, said push-up part incorporates a separate case cover push-up part and container cover push-up part structured so as to provide for a greater distance between said container cover part and container cover push-up part than between said main case cover part and case cover push-up part, thus providing means of opening said case cover only through partial operation of said push-up part.

7. A cosmetic case structure as put forth in claim 1 wherein said main case cover part encloses the area above said container cover part, when said container cover is in a closed position, said area serving as a cosmetic applicator tool storage space.

8. A cosmetic case structure as put forth in claim 1 wherein, said tray part is pivotably installed to said main case by means of said main hinge part, and space under said tray part is enclosed by said wall part of said main case as means of forming a cosmetic applicator tool storage space.

9. A cosmetic case structure as put forth in claim 1 wherein, a release part is installed at the front extremity of said main case as means of releasing the connection formed by said main latch mechanism, said release part being integrally formed with said tray part, incorporating left and right arm parts adjacently formed thereon, being capable of moving in a fore-aft direction by means of the tensile distortion characteristic provided by said arm parts, being outwardly exposed at the surface of said main case, and being able to move rearward as means of contacting and pushing upward on said main case cover part.

10. A structure for a cosmetic case comprised of, a main case enclosing an internal space defined by a wall part, a main case cover part able to close or expose said internal space by means of rotatable attachment to the rear extremity of said main case through a main hinge part, a main latch mechanism installed between the forward extremities of said main case and case cover part, said main latch mechanism being capable of holding said case cover part closed against said main case, a sealable refill container removably installed within said internal space, said sealable refill container being comprised of, (a) a main body part in which a cosmetic material holding container is formed, (b) a container cover part capable of atmospherically sealing or exposing the contents of said cosmetic material holding container by means of a detachable container hinge part, and (c) a container latch mechanism installed between the extremities of said container cover part and main body part and located opposite to said container hinge part, said container latch mechanism being capable of holing said container cover part closed against said main body part, and a cutout space formed within said wall part at a point located within a region extending from said main hinge part to main latch mechanism, as means of internally housing said container hinge part.

11. A cosmetic case structure as put forth in claim 10 wherein, said internal space is integrally formed within said main case, said sealable refill container is removably installed within said internal space, and said cutout space is formed within said wall part surrounding said internal space at a location that does not interfere with said main hinge and main latch mechanisms.

12. A cosmetic case structure as put forth in claim 10 wherein, a divider wall is provided as means of dividing said internal space into front and rear compartments, said rear compartment provides space for the removable installation of said sealable refill container, and said cutout space is formed only in the rear compartment wall at a point within a region extending from the rear compartment wall to said divider wall at a location that does not interfere with said main hinge part.

13. A cosmetic container structure as put forth in claim 10 wherein, a divider wall is provided as means of dividing said internal space into front and rear compartments, said front compartment provides space for the removable installation of said sealable refill container, and said cutout space is formed only in the front compartment wall at a point within a region extending from the front compartment wall to said divider wall at a location that does not interfere with said main latch mechanism.

14. A cosmetic case structure as put forth in claim 10 wherein, a single release part is installed at the front extremity of said main case, said single release part providing means of opening both said main case cover part and container cover part by releasing both said main latch mechanism and said container latch mechanism;

said single release part being comprised of, a pivotably supported center section to said main case, a forward extending operating part outwardly exposed at the external surface of said main case, and a push-up part extending rearward from said center section, said push-part being pivotably installed through said center section so as to movably contact said main case cover and container cover.

15. A cosmetic case structure as put forth in claim 14 wherein, said push-up part incorporates a separate case cover push-up part and container cover push-up part, said push-up part being structured so as to provide for a greater distance between said container cover part and container cover push-up part than between said main case cover part and case cover push-up part as means of opening said main case cover before said container cover.

16. A cosmetic case as put forth in claim 10 wherein a cosmetic applicator tool storage space is formed above said refill container cover part by means of said main case cover part enclosing the space above said container cover.

17. A cosmetic case structure as put forth in claim 10 wherein, a mid-frame part is pivotably installed within said main case by means of said main hinge part, said sealable refill container is removably installed to said mid-frame within said internal space of said main case, and a cosmetic applicator tool storage space is formed below said mid-frame by means of said wall part of said main case enclosing the space below said mid-frame.

* * * * *